US011511961B2

(12) United States Patent
Tanaka et al.

(10) Patent No.: US 11,511,961 B2
(45) Date of Patent: Nov. 29, 2022

(54) SHEET PROCESSING DEVICE AND IMAGE FORMING SYSTEM INCORPORATING THE SHEET PROCESSING DEVICE

(71) Applicants: Yusuke Tanaka, Kanagawa (JP); Kentaroh Fukami, Kanagawa (JP); Atsushi Kuriyama, Kanagawa (JP); Yuuki Nakagawa, Kanagawa (JP); Takato Mochizuki, Kanagawa (JP); Toshihisa Hioki, Kanagawa (JP); Takuya Fukuhara, Kanagawa (JP); Ryoh Suzuki, Kanagawa (JP)

(72) Inventors: Yusuke Tanaka, Kanagawa (JP); Kentaroh Fukami, Kanagawa (JP); Atsushi Kuriyama, Kanagawa (JP); Yuuki Nakagawa, Kanagawa (JP); Takato Mochizuki, Kanagawa (JP); Toshihisa Hioki, Kanagawa (JP); Takuya Fukuhara, Kanagawa (JP); Ryoh Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/397,118

(22) Filed: Aug. 9, 2021

(65) Prior Publication Data

US 2022/0063953 A1 Mar. 3, 2022

(30) Foreign Application Priority Data

Aug. 25, 2020 (JP) ..... JP2020-141867

(51) Int. Cl.
*B65H 45/04* (2006.01)
*B65H 45/22* (2006.01)
(Continued)

(52) U.S. Cl.
CPC ..... *B65H 45/228* (2013.01); *B65H 37/04* (2013.01); *B65H 37/06* (2013.01); *B65H 45/04* (2013.01)

(58) Field of Classification Search
CPC ..... B65H 45/04; B65H 45/14; B65H 45/20; B65H 37/06
(Continued)

(56) References Cited

U.S. PATENT DOCUMENTS 9,102,117 B2 * 8/2015 Suzuki ..... B65H 45/14
9,221,647 B2 * 12/2015 Furuhashi ..... B31F 1/10
(Continued)

FOREIGN PATENT DOCUMENTS

| | | |
|---|---|---|
| JP | 63-117872 | 5/1988 |
| JP | 2014-125312 | 7/2014 |
| JP | 2016-000654 | 1/2016 |

*Primary Examiner* — Leslie A Nicholson, III
(74) *Attorney, Agent, or Firm* — Harness, Dickey & Pierce, P.L.C.

(57) ABSTRACT

A sheet processing device includes a first conveyance passage, a first conveyor, a second conveyor, a folder, a second conveyance passage, and circuitry. The circuitry is configured to (1) cause the first conveyor and the second conveyor to convey the sheet nipping the sheet to warp the sheet between the first conveyor and the second conveyor, (2) guide the warped sheet to form a first fold on the sheet by the folder and circulate the sheet to the first conveyance passage, (3) cause the first conveyor and the second conveyor to convey the sheet while nipping the sheet again to warp the sheet between the first conveyor and the second conveyor, (4) guide the warped sheet to form a second fold on the sheet by the folder, and (5) cause the second conveyor to convey the sheet with the first fold and the second fold.

15 Claims, 30 Drawing Sheets

(51) Int. Cl.
*B65H 37/06* (2006.01)
*B65H 37/04* (2006.01)

(58) Field of Classification Search
USPC ..... 270/32; 493/419
See application file for complete search history.

(56) References Cited

U.S. PATENT DOCUMENTS

| | | | | |
|---|---|---|---|---|
| 9,533,853 | B2 * | 1/2017 | Nakagawa | B65H 45/14 |
| 9,555,998 | B2 * | 1/2017 | Watanabe | B65H 45/16 |
| 9,637,342 | B2 * | 5/2017 | Hari | B65H 37/06 |
| 9,688,502 | B2 * | 6/2017 | Sawada | B65H 45/14 |
| 9,944,490 | B2 * | 4/2018 | Saito | B65H 45/147 |
| 9,993,987 | B2 * | 6/2018 | Suzuki | B65H 45/14 |
| 10,059,558 | B2 * | 8/2018 | Suzuki | B65H 45/30 |
| 10,106,364 | B2 * | 10/2018 | Watanabe | B65H 45/20 |
| 10,239,715 | B2 * | 3/2019 | Suzuki | B65H 7/14 |
| 10,899,572 | B2 * | 1/2021 | Sakano | B65H 37/06 |
| 2009/0200725 | A1 | 8/2009 | Tamura et al. | |
| 2009/0206547 | A1 | 8/2009 | Tokita et al. | |
| 2009/0258774 | A1 | 10/2009 | Suzuki et al. | |
| 2009/0283961 | A1 | 11/2009 | Saito et al. | |
| 2010/0019435 | A1 | 1/2010 | Fukami | |
| 2010/0148417 | A1 | 6/2010 | Suzuki et al. | |
| 2010/0207314 | A1 | 8/2010 | Hattori et al. | |
| 2010/0237556 | A1 | 9/2010 | Azuma et al. | |
| 2011/0074081 | A1 | 3/2011 | Hirabayashi et al. | |
| 2012/0217693 | A1 | 8/2012 | Fukami | |
| 2015/0037119 | A1 | 2/2015 | Tanaka et al. | |
| 2015/0321871 | A1 | 11/2015 | Nakagawa et al. | |
| 2015/0336765 | A1 | 11/2015 | Sawada et al. | |
| 2016/0060072 | A1 * | 3/2016 | Watanabe | G03G 15/6529 493/442 |
| 2016/0340146 | A1 * | 11/2016 | Hama | B65H 29/125 |
| 2017/0267483 | A1 | 9/2017 | Sawada et al. | |
| 2017/0341885 | A1 * | 11/2017 | Suzuki | B65H 7/14 |
| 2018/0370751 | A1 | 12/2018 | Sawada et al. | |
| 2019/0010011 | A1 * | 1/2019 | Watanabe | G03G 15/6582 |
| 2020/0071118 | A1 | 3/2020 | Sawada et al. | |
| 2020/0231401 | A1 | 7/2020 | Fukuhara et al. | |
| 2020/0239263 | A1 | 7/2020 | Hirako et al. | |

* cited by examiner

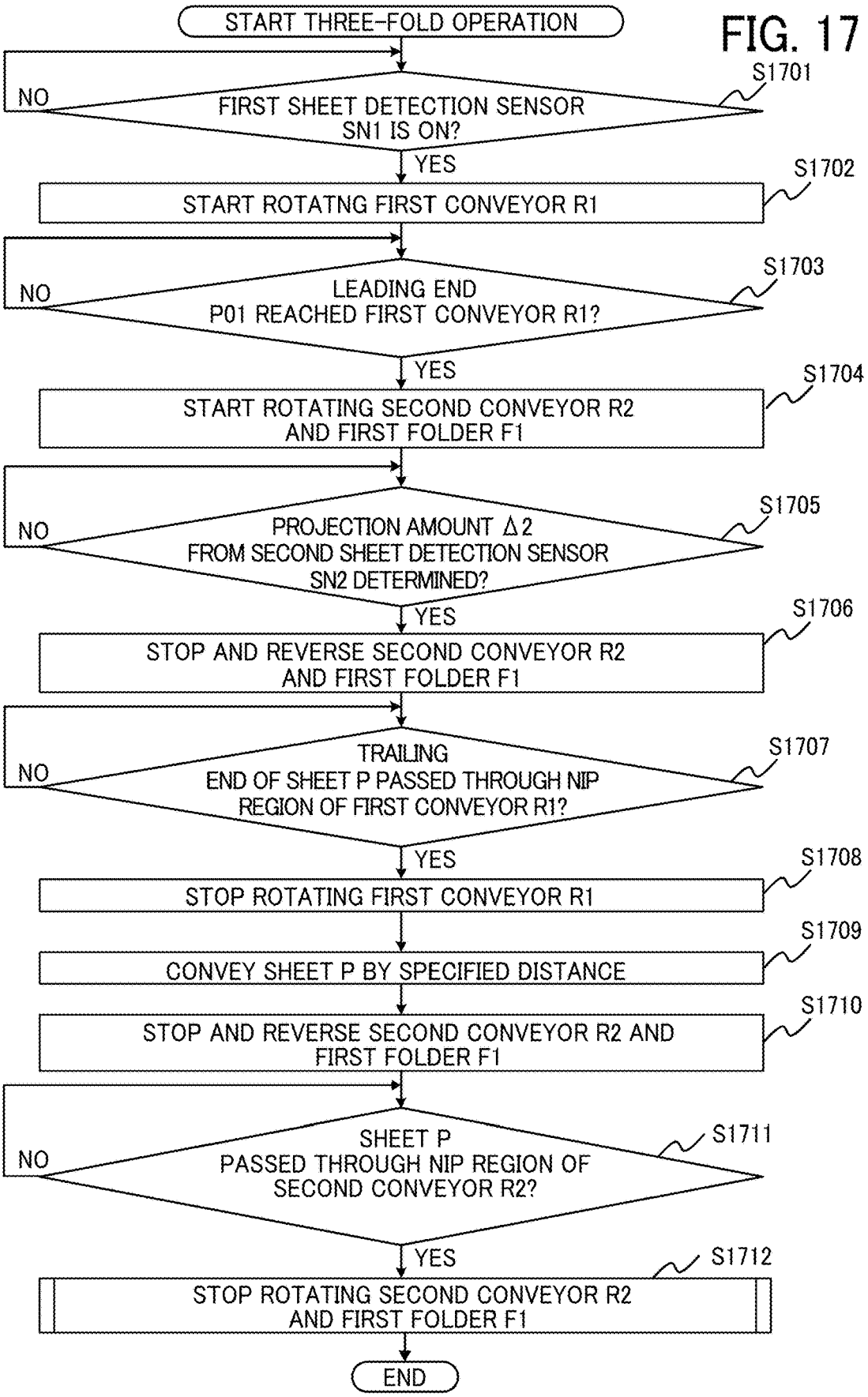
START THREE-FOLD OPERATION
FIG. 17
S1701
FIRST SHEET DETECTION SENSOR SN1 IS ON?
NO
YES
S1702
START ROTATNG FIRST CONVEYOR R1
S1703
LEADING END P01 REACHED FIRST CONVEYOR R1?
NO
YES
S1704
START ROTATING SECOND CONVEYOR R2 AND FIRST FOLDER F1
S1705
PROJECTION AMOUNT Δ2 FROM SECOND SHEET DETECTION SENSOR SN2 DETERMINED?
NO
YES
S1706
STOP AND REVERSE SECOND CONVEYOR R2 AND FIRST FOLDER F1
S1707
TRAILING END OF SHEET P PASSED THROUGH NIP REGION OF FIRST CONVEYOR R1?
NO
YES
S1708
STOP ROTATING FIRST CONVEYOR R1
S1709
CONVEY SHEET P BY SPECIFIED DISTANCE
S1710
STOP AND REVERSE SECOND CONVEYOR R2 AND FIRST FOLDER F1
S1711
SHEET P PASSED THROUGH NIP REGION OF SECOND CONVEYOR R2?
NO
YES
S1712
STOP ROTATING SECOND CONVEYOR R2 AND FIRST FOLDER F1
END

SHEET PROCESSING DEVICE AND IMAGE FORMING SYSTEM INCORPORATING THE SHEET PROCESSING DEVICE

CROSS-REFERENCE TO RELATED APPLICATION

This patent application is based on and claims priority pursuant to 35 U.S.C. § 119(a) to Japanese Patent Application No. 2020-141867, filed on Aug. 25, 2020, in the Japan Patent Office, the entire disclosure of which is hereby incorporated by reference herein.

BACKGROUND

Technical Field

Embodiments of the present disclosure relate to a sheet processing device and an image forming system incorporating the sheet processing device.

Background Art

Various types of sheet processing devices are known to perform a sheet folding operation on a sheet-like recording medium. Various types of image forming apparatus are also known to form an image on a recording medium and include such a sheet processing device that performs the sheet folding operation on the recording medium. Further, various types of image forming systems are known to include a post-processing apparatus and an image forming apparatus. In the image forming system, the image forming apparatus forms an image on a recording medium, the sheet processing device performs the sheet folding operation on the recording medium, and the post-processing apparatus performs a predetermined post-processing operation on the recording medium after the sheet folding operation.

Such a sheet processing device included in the above-described image forming apparatus performs multiple types of sheet folding operations. For example, the multiple types of sheet folding operations performed by the sheet processing device include "two folds" (also referred to as "half-fold") in which one recording medium is folded so as to be divided into two panels and "three folds" in which one recording medium is folded so as to be divided into three panels. Specifically, the "two folds" applies a single, central fold to create two equal panels. The three fold includes "letter fold-in" in which two folds are performed in the same direction and "letter fold-out" in which two folds are performed in different directions. Specifically, the "letter fold-in" applies two folds to create three equal panels with the outer panels folding inward and the "letter fold-out" applies two folds to create three equal panels with the first panel folding inward and the last panel folding outward. One type of the letter fold-out is known as a "Z-fold" in which the recording medium is folded at a position corresponding to three-fourth (¾) of the entire length of the recording medium in the first fold and is folded at a position corresponding to one-half (½) in the second fold.

SUMMARY

Embodiments of the present disclosure described herein provide a novel sheet processing device including a first conveyance passage, a first conveyor, a second conveyor, a folder, a second conveyance passage, and circuitry. The first conveyance passage is configured to pass a sheet downstream in a sheet conveyance direction. The first conveyor is configured to convey the sheet in the first conveyance passage. The second conveyor is disposed downstream from the first conveyor in the sheet conveyance direction. The folder is disposed between the first conveyor and the second conveyor. The folder is configured to form a fold on the sheet. The second conveyance passage is configured to circulate, to the first conveyance passage, the sheet with the fold being formed after the sheet passes through the folder. The circuitry is configured to control conveyance of the sheet, movement of the first conveyor, and movement of the second conveyor. The circuitry is configured to: (1) cause the first conveyor to convey the sheet in the sheet conveyance direction and the second conveyor to convey the sheet in a reverse direction opposite to the sheet conveyance direction while the first conveyor and the second conveyor nip the sheet, to warp the sheet between the first conveyor and the second conveyor; (2) guide the sheet warped between the first conveyor and the second conveyor, to the folder, to form a first fold on the sheet by the folder, and cause the sheet to be circulated to the first conveyance passage via the second conveyance passage; (3) cause the first conveyor to convey the sheet in the sheet conveyance direction and the second conveyor to convey the sheet in the reverse direction opposite to the sheet conveyance direction while the first conveyor and the second conveyor nip the sheet again, to warp the sheet between the first conveyor and the second conveyor; (4) guide the sheet warped between the first conveyor and the second conveyor, to the folder, to form a second fold on the sheet by the folder; and (5) cause the second conveyor to convey the sheet with the first fold and the second fold, in the sheet conveyance direction.

Further, embodiments of the present disclosure described herein provide an image forming system including an image forming apparatus and the above-described sheet processing device. The image forming apparatus is configured to form an image on a sheet. The sheet processing device is configured to perform a sheet folding operation to form a fold on the sheet.

Further, embodiments of the present disclosure described herein provide an image forming system including an image forming apparatus, the above-described sheet processing device, and a post-processing apparatus. The image forming apparatus is configured to form an image on a sheet. The sheet processing device is configured to perform a sheet folding operation to form a fold on the sheet. The post-processing apparatus is configured to perform a post-processing operation on the sheet. The circuitry is configured to convey the sheet in the sheet conveyance direction from the sheet folding device to the post-processing apparatus with the second fold as a trailing end of the sheet when the post-processing apparatus performs a punching operation as the post-processing operation. The circuitry is configured to convey the sheet in the sheet conveyance direction from the sheet folding device to the post-processing apparatus with the second fold as a leading end of the sheet when the post-processing apparatus performs a stapling operation to bind and staple a bundle of sheets including the sheet as the post-processing operation.

BRIEF DESCRIPTION OF THE SEVERAL VIEWS OF THE DRAWINGS

Exemplary embodiments of this disclosure will be described in detail based on the following figures, wherein:

FIG. 17 is a flowchart of a flow of a sheet folding operation performed by the sheet folding device, following the flow of FIG. 15;

Figure 1:
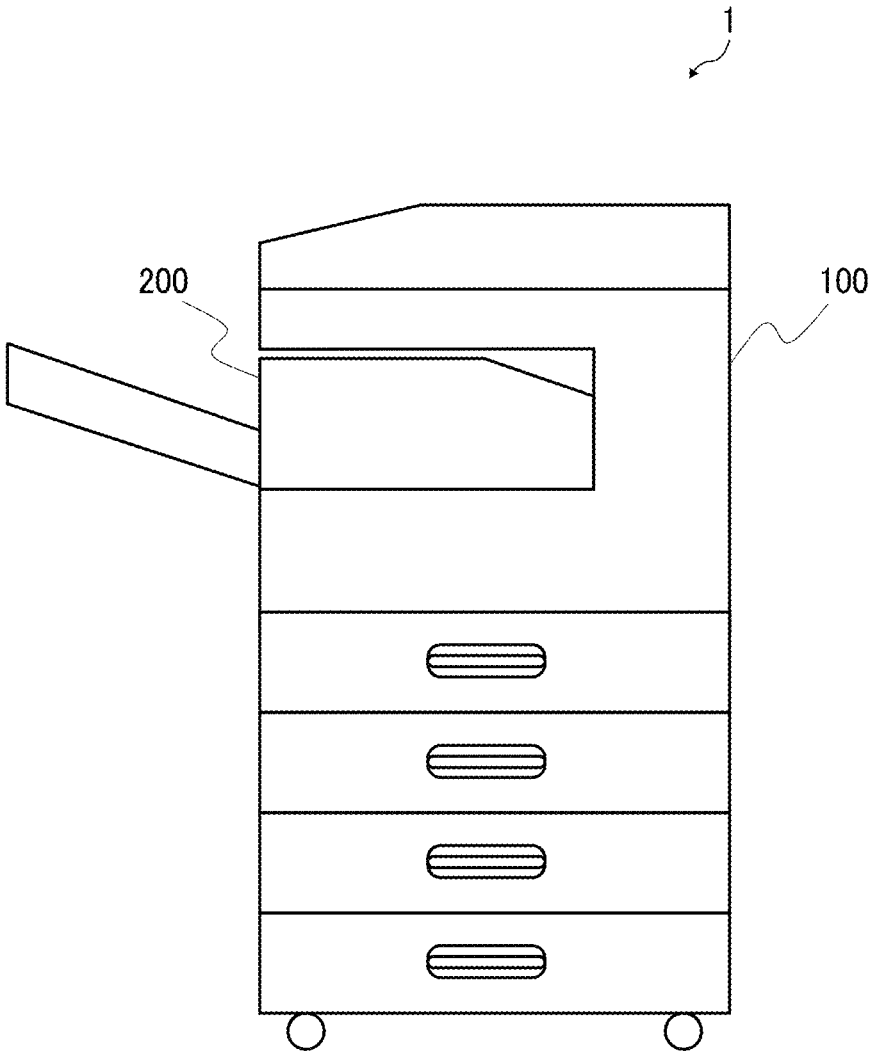
FIG. 1 is a side view of an image forming system according to an embodiment of the present disclosure, where the image forming system includes a sheet processing device according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

Descriptions are given of a sheet processing device according to the present disclosure, an image forming apparatus incorporating the sheet processing device, and an image forming system incorporating the sheet processing device, with reference to the accompanying drawings.

Known sheet processing devices perform a "Z-fold" operation on a recording medium. Since the folded, overlapped portion of the Z-folded recording medium is thicker than the other portion, each Z-folded recording medium has a thickness difference in the surface direction of the Z-folded recording medium. As the Z-folded recording media are ejected to a sheet ejection tray, the thickness difference of the Z-folded recording media stacked on the sheet ejection tray is generated in a sheet ejection direction. Since a sheet ejection tray on which the ejected recording media are stacked is often inclined upward toward the sheet ejection direction of the recording medium, the thicker portion, in other words, Z-folded portion of the recording medium is located on the downstream side of the sheet ejection tray. In a case in which the thicker portions of the Z-folded recording media overlap each other at the downstream side of the sheet ejection tray, the inclination of the recording media stacked on the sheet ejection tray increases to be greater than the inclination of the sheet ejection tray, and even if the number of recording media is small, the inclination of the recording media reaches the stacking limit of the sheet ejection tray.

That is, even if the number of recording media stacked on the sheet ejection tray is smaller than the upper limit of the number of recording media stackable on the sheet ejection tray, the Z-fold recording media may not be stacked. As a result, the stackable amount (or number) of Z-fold recording media may be smaller than the maximum amount (or number) of recording media on the sheet ejection tray.

A known sheet processing device includes a sheet reversing unit that reverses the direction of conveyance of a Z-fold recording medium (sheet) between the forward direction and the reverse direction to change the position of the thicker portion to prevent a reduction in the stackable amount of recording media.

In the known sheet processing device, however, the sheet reversing unit is required to direct the folded portion of the Z-fold recording medium toward the base end of the sheet stacking tray, which causes an increase in size of the entire device.

As will be described below, the sheet processing device according to the present embodiment prevents a decrease in the stack amount of "Z-folded sheets" produced by performing Z-folding on a sheet-like recording medium. In order to prevent such a decrease in the stack amount of Z-folded sheets, the sheet processing device has a configuration that reduces the whole size of the sheet processing device as to reverse the position of the "folded portion" of the Z-folded sheets in the sheet conveyance direction. That is, the sheet processing device has a compact configuration in which the sheet ejection direction of the Z-folded sheets is reversed without decreasing the stack amount of the Z-folded sheets on the sheet ejection tray.

Embodiment of Image Forming Apparatus

First, a description is given of an image forming system according to an embodiment of the present disclosure.

FIG. 1 is an external view of an image forming system 1 that is appeared as a printer.

The image forming system 1 includes an image forming apparatus 100 that is a printer housing, and a sheet folding device 200 that functions as a sheet processing device that is connectable to the image forming apparatus 100. As illustrated in FIG. 1, the image forming system 1 is an in-body ejection type apparatus, and the sheet folding device 200 is incorporated in a part of the image forming apparatus 100, as a sheet processing device. That is, in the image forming system 1, the in-body ejection portion to which a recording medium is ejected corresponds to the sheet folding device 200. The configuration of the sheet folding device 200 is described below.

Functional Configuration of Control Block

Figure 2:
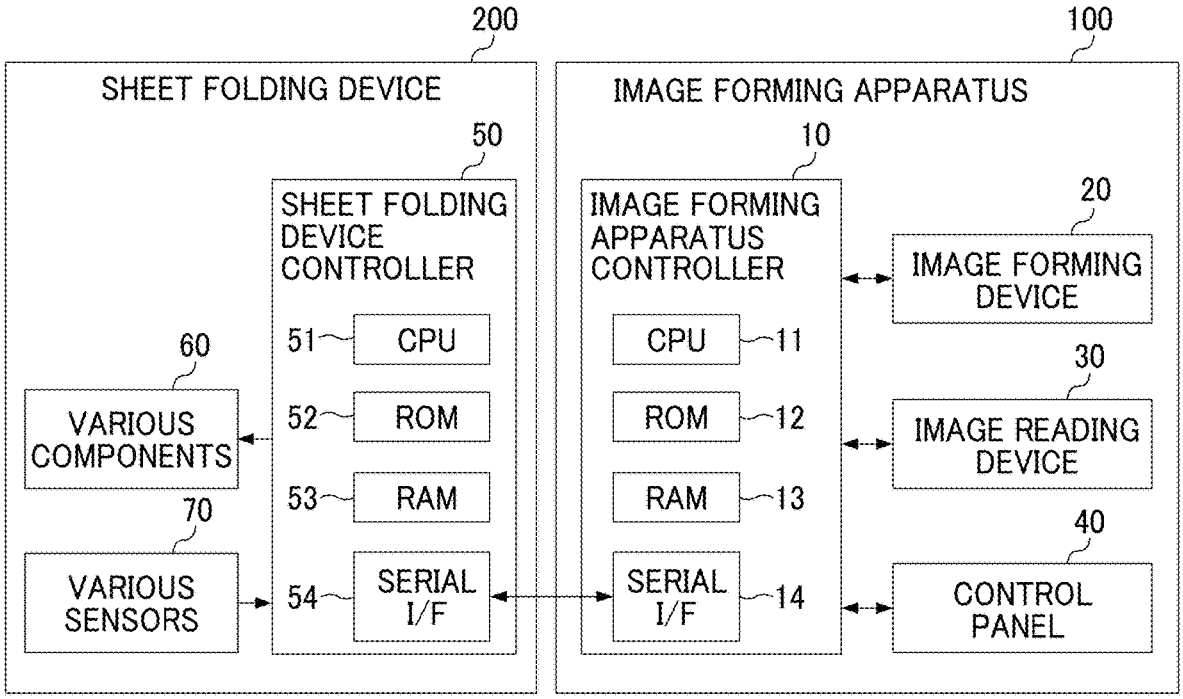
FIG. 2 is a block diagram illustrating a control configuration of the image forming system of FIG. 1.

Next, a description is given of an exemplary configuration of a control block that controls operations of the image forming apparatus 100 and the sheet folding device 200, according to the present embodiment, with reference to FIG. 2.

FIG. 2 is a block diagram illustrating a control configuration of the image forming apparatus of FIG. 1.

As illustrated in FIG. 2, the image forming apparatus 100 includes an image forming apparatus controller 10 as a control block. The image forming apparatus controller 10 includes a central processing unit (CPU) 11, a read-only memory (ROM) 12, a random access memory (RAM) 13, and a serial interface (serial I/F) 14.

The image forming apparatus controller 10 is connected to an image forming device 20, an image reading device 30, and a control panel 40. Each of the image forming device 20, the image reading device 30, and the control panel 40 includes components to fully perform the functions. Each component of the image forming device 20, the image reading device 30, and the control panel 40 operates based on a control signal issued by the image forming apparatus controller 10.

The image forming device 20 is configured to perform an image forming operation based on image data on a sheet P that functions as a recording medium or a sheet-like recording medium. The image reading device 30 reads an image formed on the sheet P and acquires the image data of the image on the sheet P. The control panel 40 functions as an input unit via which operating conditions in the image forming device 20 and the image reading device 30 are input and as a display unit that displays, for example, the operation results.

The ROM 12 stores control programs for controlling the image forming device 20, the image reading device 30, and the control panel 40. The CPU 11 reads the control programs stored in the ROM 12 to the RAM 13. Then, the CPU 11 stores data in the RAM 13 to use the date for the control and executes the control defined by the control programs while using the RAM 13 as a work area.

As illustrated in FIG. 2, the sheet folding device 200 includes a sheet folding device controller 50 as a control block. The sheet folding device controller 50 includes a central processing unit (CPU) 51, a read only memory (ROM) 52, a random access memory (RAM) 53, and a serial interface (serial I/F) 54.

The sheet folding device controller 50 is connected to various members 60 and various sensors 70. The various members 60 are, for example, pairs of sheet conveyance rollers and pairs of sheet folding rollers and include configurations to perform sheet folding operations on a recording medium or recording media. The various sensors 70 are a plurality of sheet detectors to detect the recording medium and include configurations to detect the position of the recording medium that functions as a sheet folding target on which the sheet folding operation is performed. Each of the various members 60 operates based on a control signal issued by the sheet folding device controller 50. The sheet folding device controller 50 executes processes according to the control program based on the detection signal from each of the various sensors 70 and sends the control signal to each of the various members 60.

The control programs with which the sheet folding device controller 50 executes the predetermined processes are stored in the ROM 52. The CPU 51 reads the control programs stored in the ROM 52 to the RAM 53. Then, the CPU 51 stores data in the RAM 53 to use the date for the control and executes the control of the sheet folding operation defined by the control programs while using the RAM 53 as a work area.

The image forming apparatus controller 10 included in the image forming apparatus 100 and the sheet folding device controller 50 included in the sheet folding device 200 are communicably connected to each other via the serial I/F 14 and the serial I/F 54. This communication path is used to exchange control commands to be used for conveyance control of the recording medium, between the image forming apparatus controller 10 and the sheet folding device controller 50. The sheet folding device 200 is capable of determining whether or not to perform the conveyance control and the sheet folding operation on a recording medium and switching the types of the sheet folding operation, based on the control command sent from the image forming apparatus 100 and information related to the recording medium (position information of the recording medium) obtained from the various sensors 70.

First Embodiment of Sheet Folding Device

Next, a description is given of the sheet folding device 200 according to a first embodiment of the present disclosure.

Figure 3:
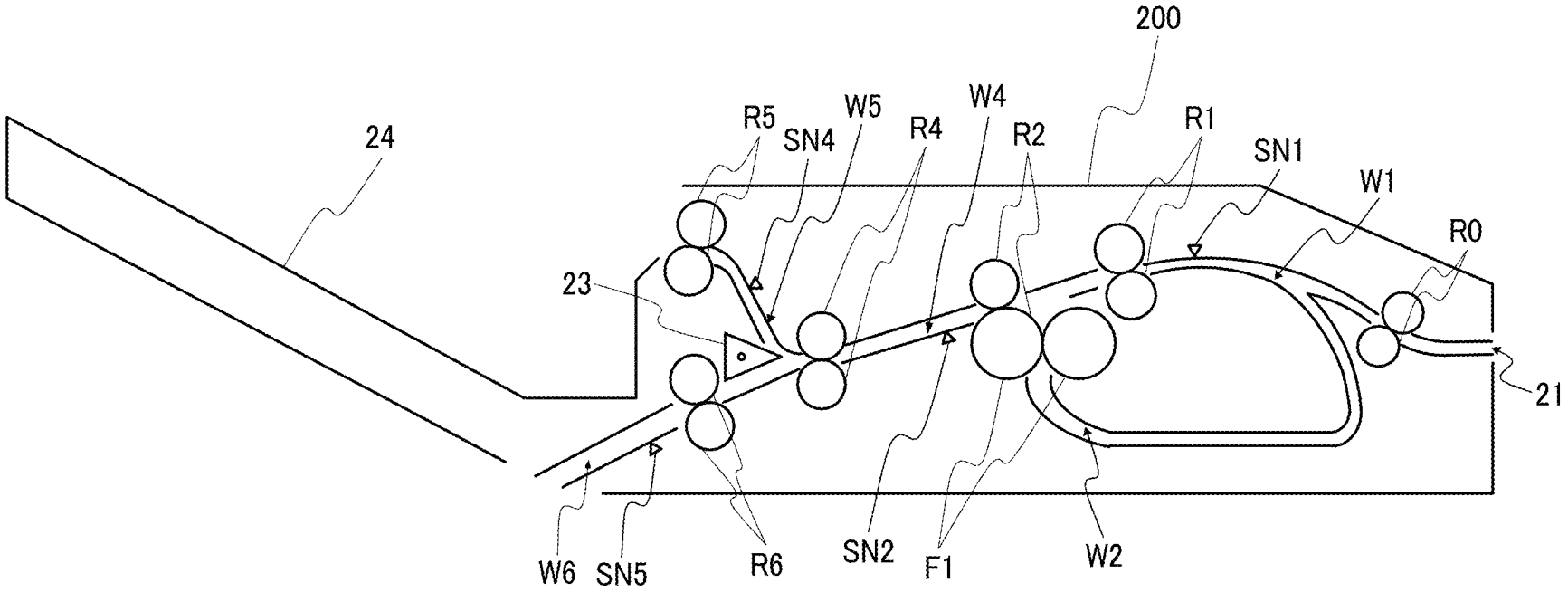
FIG. 3 is a diagram illustrating an inner configuration of a sheet folding device functioning as the sheet processing device according to the present disclosure.

FIG. 3 is a diagram illustrating a schematic configuration of a sheet folding device 200 according to the present embodiment.

The sheet folding device 200 includes a plurality of sheet conveyance passages. The plurality of sheet conveyance passages of the sheet folding device 200 according to the present embodiment is roughly five sheet conveyance passages. For example, the sheet folding device 200 includes a first sheet conveyance passage W1, a second sheet conveyance passage W2, a fourth sheet conveyance passage W4, a fifth sheet conveyance passage W5, and a sixth sheet conveyance passage W6.

As illustrated in FIG. 3, the sheet folding device 200 includes a sheet inlet port 21 through which the sheet P that is a process target is conveyed to the sheet folding device 200. The sheet inlet port 21 of the sheet folding device 200 is connected to a sheet ejection port of the image forming apparatus 100. Inlet sheet conveyor R0 are disposed near the sheet inlet port 21. The inlet sheet conveyor R0 include a pair of rollers driven and rotated by a drive motor. The sheet P is conveyed along the first sheet conveyance passage W1 by rotations of the inlet sheet conveyor R0.

The sheet folding device 200 includes a first sheet conveyor R1, a second sheet conveyor R2, and a first sheet folder F1, along the first sheet conveyance passage W1. The first sheet folder F1 are disposed between the first sheet conveyance passage W1 and the second sheet conveyance passage W2. The first sheet folder F1 has a function to fold the sheet P brought along the first sheet conveyance passage W1, at a predetermined position, and to transfer the sheet P folded by the first sheet folder F1, to the second sheet conveyance passage W2.

The first sheet conveyor R1 includes a pair of rollers (two rollers) disposed facing each other across the first sheet conveyance passage W1. The pair of rollers (i.e., the first sheet conveyor R1) forms a nip region. The first sheet folder F1 includes a pair of rollers (two rollers) disposed facing each other between the first sheet conveyance passage W1 and the second sheet conveyance passage W2. The pair of rollers (i.e., the first sheet folder F1) also forms a nip region. A sheet conveyance passage to which the sheet P is guided by the nip region of the first sheet folder F1 guides the sheet P from the first sheet conveyance passage W1 to the second sheet conveyance passage W2. The second sheet conveyance passage W2 meets the upstream side of the first sheet conveyor R1 on the first sheet conveyance passage W1. Due to this configuration, the first sheet conveyance passage W1, the first sheet conveyor R1, the first sheet folder F1, and the second sheet conveyance passage W2 function as a sheet circulation passage.

The second sheet conveyor R2 is disposed downstream from the first sheet conveyor R1 in the sheet conveyance direction. The second sheet conveyor R2 includes a pair of rollers (two rollers). The second sheet conveyor R2 including the pair of rollers (two rollers) shares one roller with the first sheet folder F1 including the pair of rollers (two rollers). The common roller shared by the second sheet conveyor R2 and the first sheet folder F1 is driven and rotated by the common drive motor. The drive motor is rotatable in the forward direction and the reverse direction that is opposite to the forward direction. Changing the direction of rotation of the drive motor switches conveyance of the sheet P or the sheet folding operation on the sheet P.

A first sheet detection sensor SN1 is disposed on the first sheet conveyance passage W1. The first sheet detection sensor SN1 is disposed immediately before the first sheet conveyor R1. In other words, the first sheet detection sensor SN1 is disposed upstream from the first sheet conveyor R1 in the sheet conveyance direction. A fourth sheet conveyor R4 is disposed downstream from the second sheet conveyor R2 in the sheet conveyance direction. The fourth sheet conveyance passage W4 lies between the second sheet conveyor R2 and the fourth sheet conveyor R4. A second sheet detection sensor SN2 is disposed on the fourth sheet conveyance passage W4. The second sheet detection sensor SN2 is disposed immediately before the second sheet conveyor R2. In other words, the second sheet detection sensor SN2 is disposed downstream from the second sheet conveyor R2 in the sheet conveyance direction.

A switching claw 23 is disposed downstream from the fourth sheet conveyor R4 in the sheet conveyance direction. A fifth sheet conveyor R5 is disposed on a branched sheet conveyance passage downstream from the switching claw 23 in the sheet conveyance direction. A sixth sheet conveyor R6 is disposed at another branched sheet conveyance passage downstream from the switching claw 23 in the sheet conveyance direction. The fifth sheet conveyance passage W5 runs between the switching claw 23 and the fifth sheet conveyor R5. The sixth sheet conveyance passage W6 runs downstream from the switching claw 23 and passes through the sixth sheet conveyor R6.

A fourth sheet detection sensor SN4 is disposed on the fifth sheet conveyance passage W5. The fourth sheet detection sensor SN4 is disposed between the switching claw 23 and the fifth sheet conveyor R5. A fifth sheet detection sensor SN5 is disposed on the sixth sheet conveyance passage W6. The fifth sheet detection sensor SN5 is disposed immediately after the sixth sheet conveyor R6 in the sheet conveyance direction.

Each of the above-described sensors correspond to the various sensors 70 (see FIG. 2). Each of the various sensors 70 detects the sheet P and notifies the detection signal to the sheet folding device controller 50. That is, the sheet folding device controller 50 determines the conveyance position of the sheet P based on the detection signal from each of the various sensors 70, and performs conveyance control of the sheet P. Further, the sheet folding device controller 50 controls start and stop of rotations of the rollers of each sheet conveyance member described above or controls switching of the direction of rotations of the rollers of each sheet conveyance member described above, based on the detection signal from each of the various sensors 70.

Further, the switching claw 23 disposed immediately after the fourth sheet conveyor R4 switches the guide position of the sheet P conveyed by the fourth sheet conveyor R4 between a case in which the sheet P is conveyed to the fifth sheet conveyance passage W5 and a case in which the sheet P is conveyed to the sixth sheet conveyance passage W6. The switching claw 23 may switch the guide position by, for example, a solenoid. Note that the solenoid may be replaced by a driving mechanism including, for example, motor, gear, and cam.

The sheet P guided to the fifth sheet conveyance passage W5 is ejected to a sheet stacking tray 24 that functions as a sheet ejection tray (or simply, a sheet tray) included in the sheet folding device 200. The sheet stacking tray 24 stacks and holds the sheet P or the sheets P ejected by the fifth sheet conveyance rollers R5. Details of the sheet stacking tray 24 are described below.

In a case in which a post-processing apparatus 300 is disposed downstream from the sheet folding device 200 that is included in an image forming system, the sheet P guided to the sixth sheet conveyance passage W6 is conveyed to the post-processing apparatus 300. That is, the sixth sheet conveyance passage W6 is a sheet conveyance passage through which the sheet P is conveyed to the post-processing apparatus 300. The post-processing apparatus 300 performs various post-processing operations, for example, alignment operations and binding operations, on folded sheets P or non-folded sheets P. The configuration of the post-processing apparatus 300 is described below.

Overview of Sheet Folding Operation Performed by Sheet Folding Device 200

Next, a description is given of the overview of the sheet folding device 200. The sheet folding device 200 is capable of ejecting the sheet P without performing the sheet folding operation and of performing two folds (i.e., half-fold), Z-fold, three folds (i.e., letter fold-in and letter fold-out) after receiving the sheet P ejected from the image forming apparatus 100. Hereinafter, a description is given of the overview of operations of the sheet folding device 200 according to various types of operations, with reference to the drawings.

FIGS. 4 to 7 are enlarged views of the inner configuration of the sheet folding device 200.

FIGS. 4 to 7 illustrate the operations of conveyance the sheet P without being folded, from the upstream side (that is, the image forming apparatus 100) to the downstream side (that is, the sheet stacking tray 24 or the post-processing apparatus 300) in the sheet conveyance direction.

Figure 4:
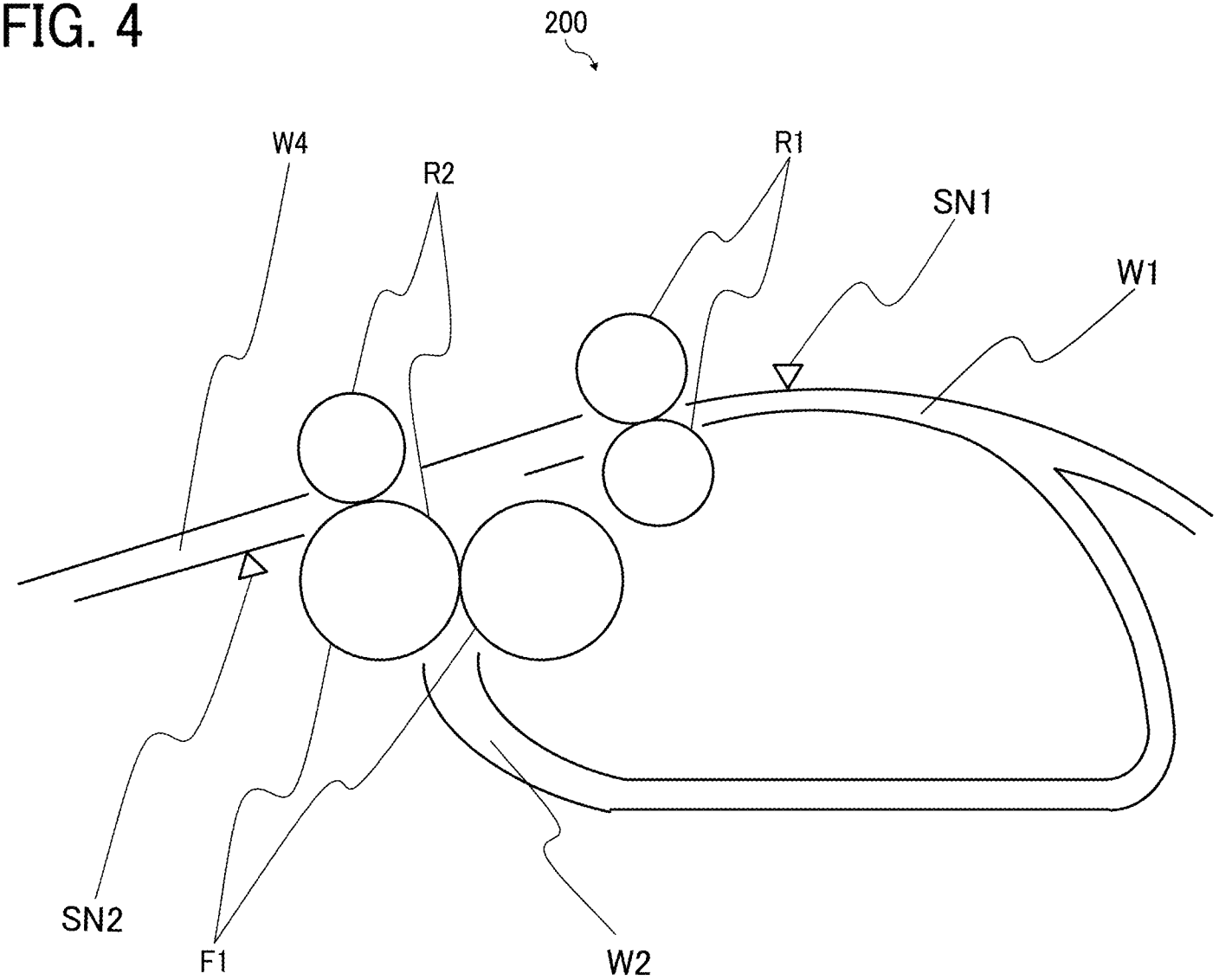
FIG. 4 is an enlarged view of the inner configuration of the sheet folding device according to a first embodiment, following FIG. 3.

Specifically, FIG. 4 illustrates the sheet folding device 200 in an initial state before the sheet P is conveyed from the image forming apparatus 100.

Figure 5:
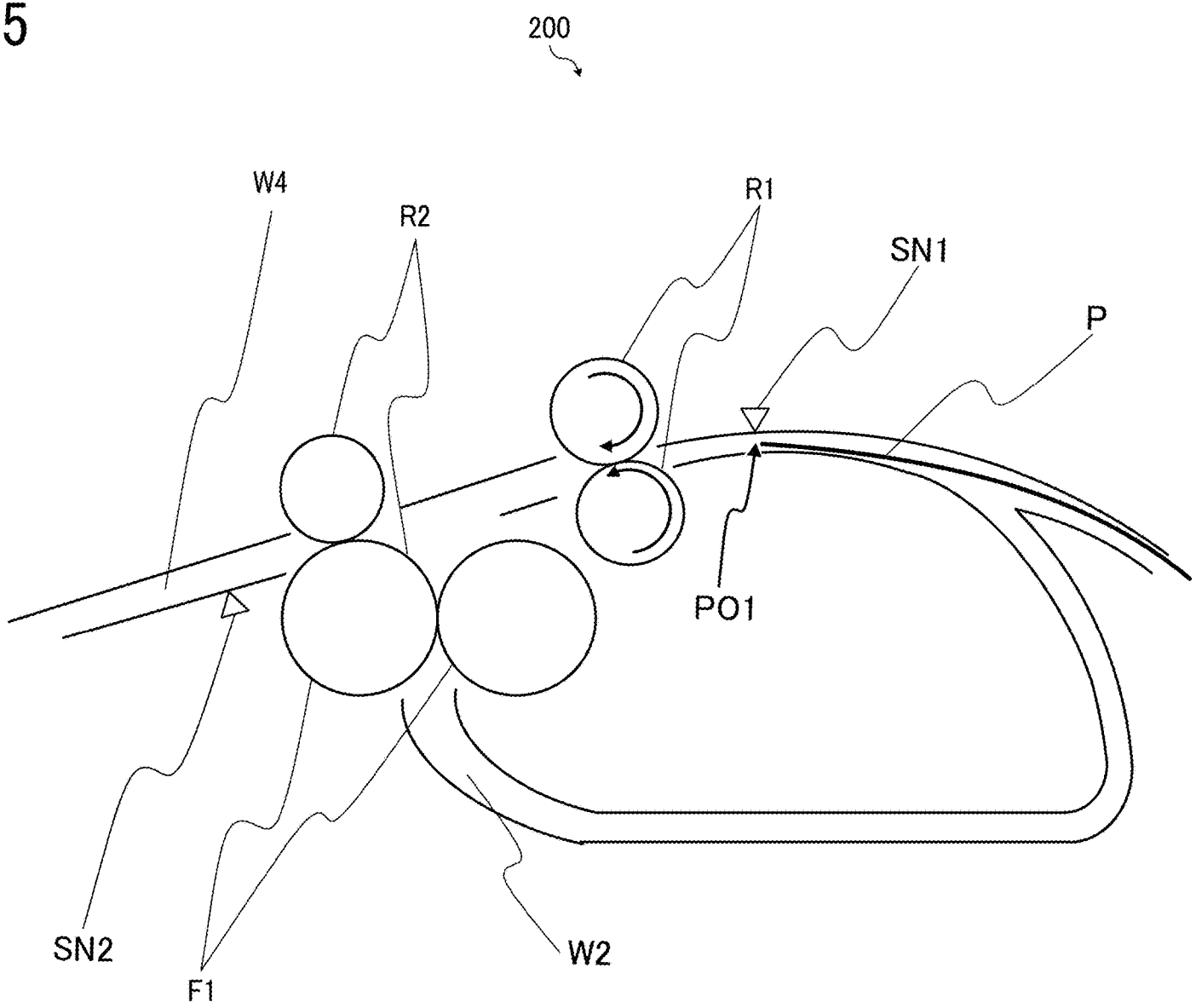
FIG. 5 is an enlarged view of the inner configuration of the sheet folding device according to the first embodiment, following FIG. 4.

FIG. 5 illustrates the sheet folding device 200 in a state in which the sheet P is conveyed in the sheet folding device 200.

As illustrated in FIGS. 4 and 5, the sheet P is conveyed from the image forming apparatus 100, and the leading end P01 of the sheet P is detected by the first sheet detection sensor SN1. The sheet folding device controller 50 causes (instructs) the first sheet conveyor R1 to rotate based on the detection result of the first sheet detection sensor SN1. At this time, the rotational direction of the first sheet conveyor R1 is a direction indicated by arrows in FIG. 5. At a timing at which leading end P01 of the sheet P enters the nip region of the first sheet conveyor R1 while the first sheet conveyor R1 is rotating, the sheet P is conveyed toward the second sheet conveyor R2.

Figure 6:
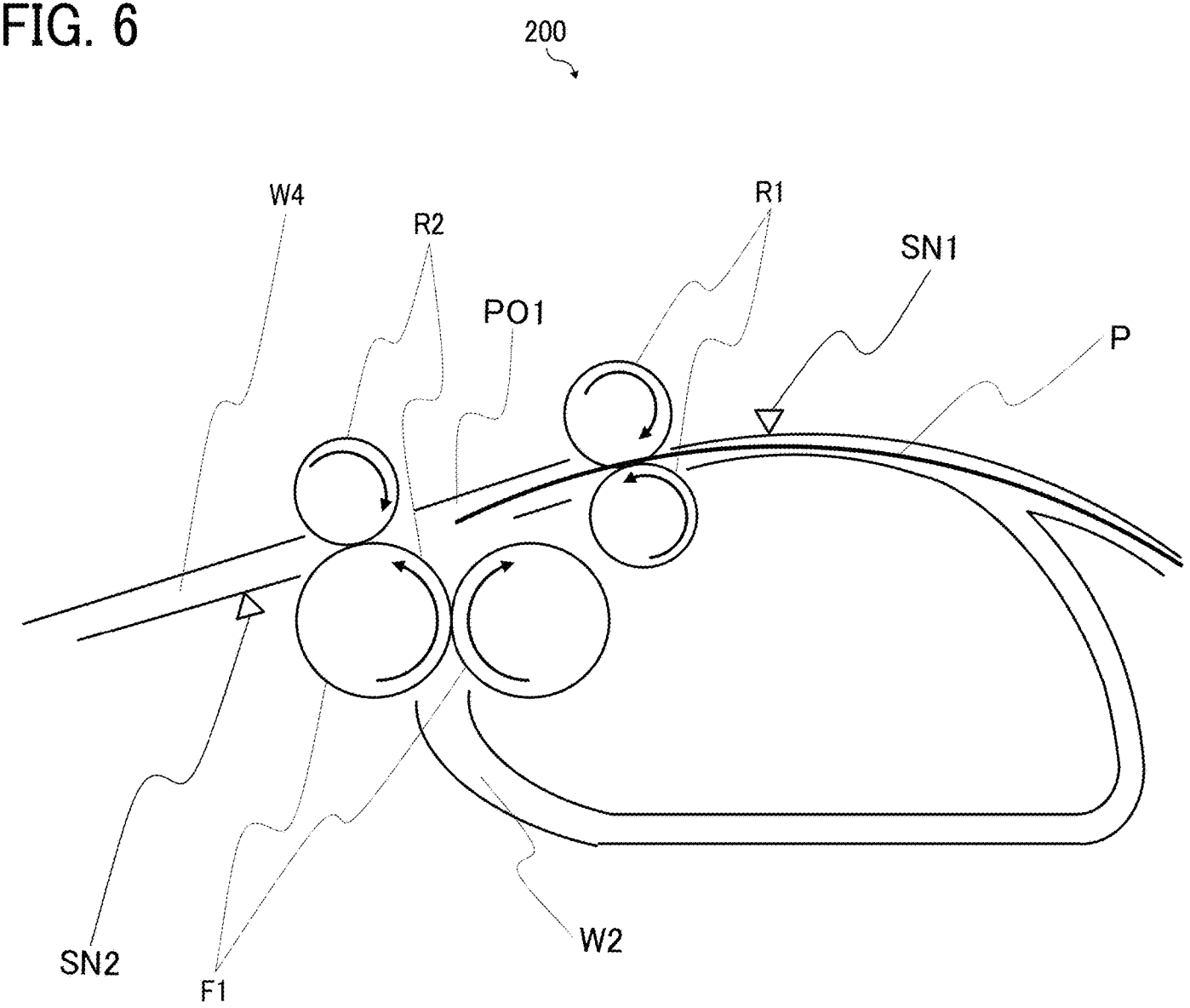
FIG. 6 is an enlarged view of the inner configuration of the sheet folding device according to the first embodiment, following FIG. 5.

FIG. 6 is an enlarged view of the inner configuration of the sheet folding device 200 according to the first embodiment, following FIG. 5.

Then, as illustrated in FIG. 6, at a timing at which the leading end P01 of the sheet P is conveyed immediately before the nip region of the second sheet conveyor R2, the second sheet conveyor R2 starts rotating based on the control signal from the sheet folding device controller 50. According to this control, the first sheet conveyor R1 and the second sheet conveyor R2 rotate in the same direction (arrows in FIG. 6).

Figure 7:
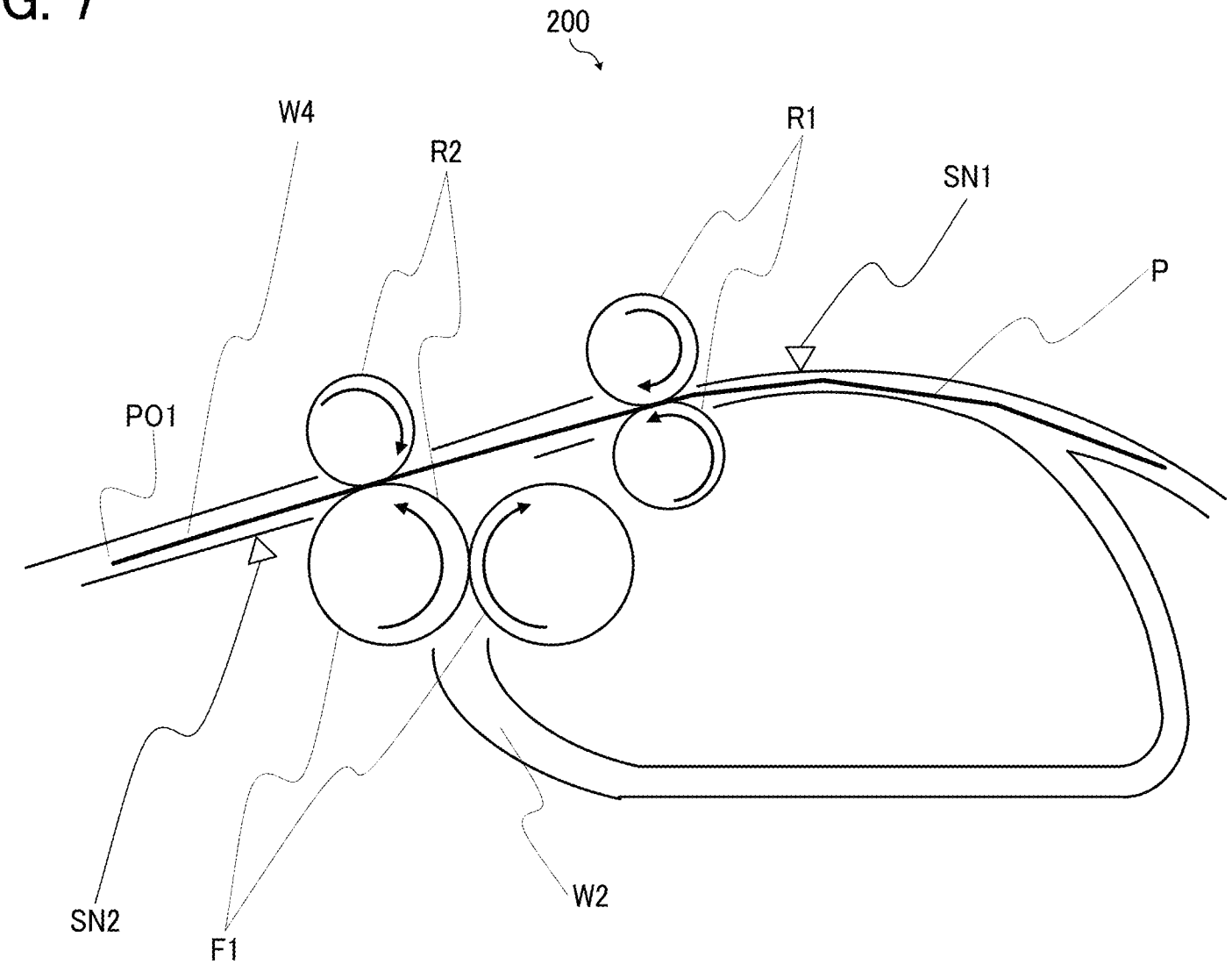
FIG. 7 is an enlarged view of the inner configuration of the sheet folding device according to the first embodiment, following FIG. 6.

FIG. 7 is an enlarged view of the inner configuration of the sheet folding device 200 according to the first embodiment, following FIG. 6.

Following this operation, as illustrated in FIG. 7, the sheet P is conveyed downstream by rotations of the first sheet conveyor R1 and rotations of the second sheet conveyor R2. As a result, as the first sheet conveyor R1 and the second sheet conveyor R2 convey the sheet P, the sheet P is ejected toward the sheet stacking tray 24 or the post-processing apparatus 300. Note that whether the leading end P01 of the sheet P is conveyed to a position immediately before the nip region of the second sheet conveyor R2 is determined based on, for example, the number of steps of a drive motor that drives and rotates the first sheet conveyor R1 by the sheet folding device controller 50. Accordingly, the sheet folding device controller 50 causes the second sheet conveyor R2 to start rotating based on the determination result.

Overview of Z-Fold Operation

Next, a description is given of operations of the sheet folding device 200 when performing the Z-fold on the sheet P, with reference to FIGS. 8 to 12.

FIGS. 8 to 12 are enlarged views of the inner configuration of the sheet folding device 200 and illustrates the operations of conveyance of the sheet P when the sheet folding device 200 performs a Z-fold operation on the sheet P.

The Z-fold operation of the sheet folding device 200 is the same operations as the initial operation of the sheet folding device 200, with reference to FIGS. 5 and 6. Accordingly, when the sheet folding device 200 performs the Z-fold operation, as the operation in FIG. 6, the first sheet conveyor R1 conveys the sheet P and the leading end P01 of the sheet P reaches the nip region of the second sheet conveyor R2. Then, after the first sheet conveyor R1 and the second sheet conveyor R2 rotate in the respective rotational directions indicated by the respective arrows, the sheet folding device 200 performs the operations illustrated in the following drawings including FIG. 8.

Figure 8:
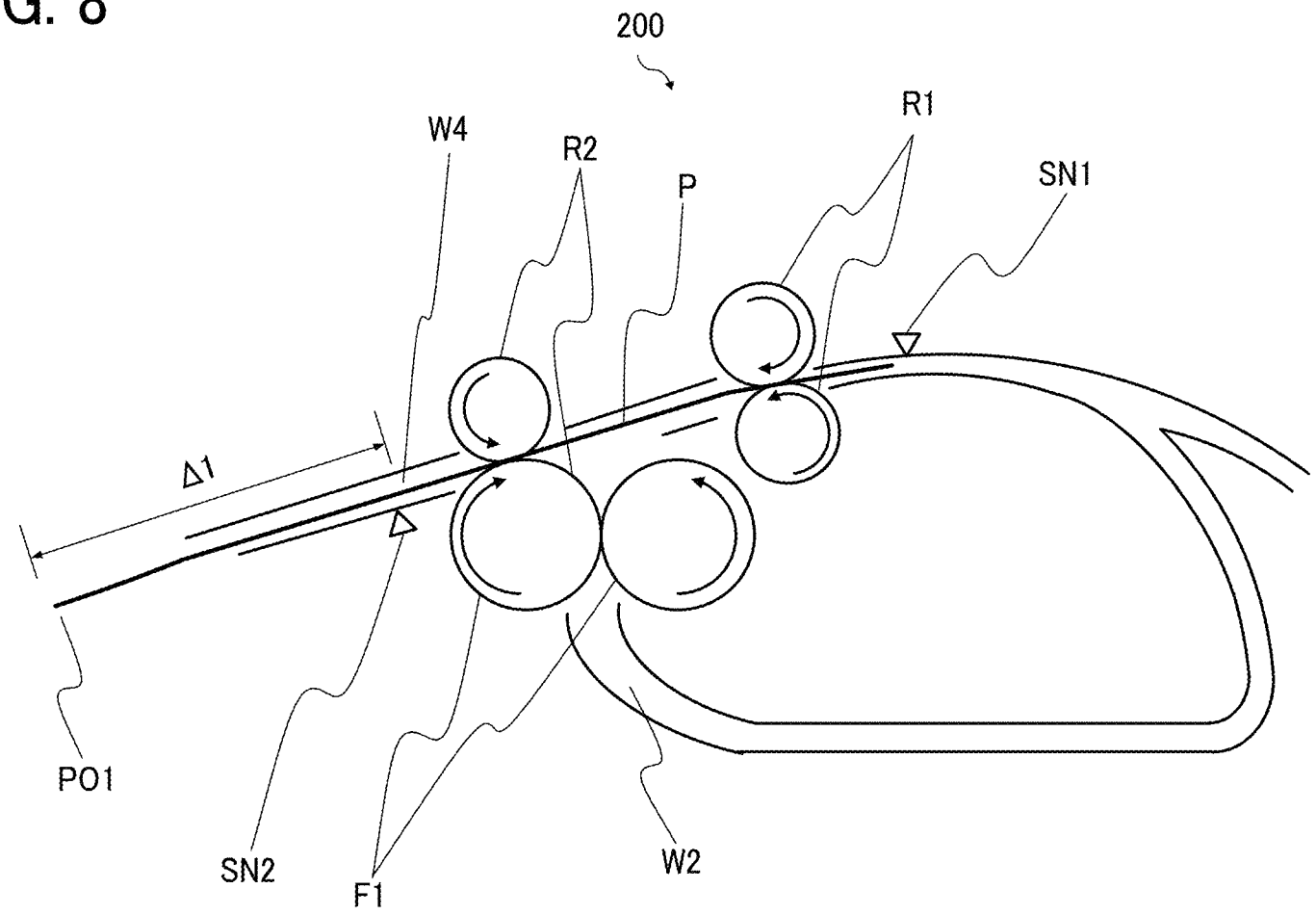
FIG. 8 is an enlarged view of the inner configuration of the sheet folding device according to the first embodiment, following FIG. 7.

FIG. 8 is an enlarged view of the inner configuration of the sheet folding device 200 according to the first embodiment, following FIG. 7.

As illustrated in FIG. 8, while nipping the sheet P, the first sheet conveyor R1 and the second sheet conveyor R2 convey the sheet P to the downstream side of the second sheet conveyor R2 in the sheet conveyance direction. At this time, the sheet folding device controller 50 acquires the timing at which the second sheet detection sensor SN2 detected the leading end P01 of the sheet P, and then acquires the amount of rotations of the second sheet conveyor R2. Then, the sheet folding device controller 50 calculates the amount of projection (projection amount) of the leading end P01 of the sheet P from the position of the second sheet detection sensor SN2, based on the amount of rotations of the first sheet conveyor R1, the amount of rotations of the second sheet conveyor R2, or the amount of rotations of the first sheet conveyor R1 and the second sheet conveyor R2. The projection amount of the leading end P01 of the sheet P is also referred to as a first projection amount Δ1. The first projection amount Δ1 corresponds to information used for setting a first folding position.

When performing the Z-fold operation, the first folding position corresponds to a position of three-fourth (¾) of the entire length of the sheet P from the leading end P01 of the sheet P (i.e., the length of the sheet in the sheet conveyance direction), that is, at a position corresponding to one-fourth (¼) of the length of the sheet P, on the trailing end of the sheet P in the sheet conveyance direction. A first fold at the first folding position is a "fold-out." Thereafter, in a case in which a second fold is formed on the sheet P having the first fold, the second folding position corresponds to a position of one-half (½) of the entire length of the sheet P from the leading end P01 of the sheet P. Note that the second fold is a "fold-in."

Accordingly, from when the second sheet detection sensor SN2 detects the leading end P01 of the sheet P to when the leading end P01 of the sheet P reaches the position corresponding to the predetermined first projection amount Δ1, the sheet P is conveyed to the downstream side in the sheet conveyance direction by the first sheet conveyor R1 and the second sheet conveyor R2.

Note that the sheet folding device controller 50 determines the first projection amount Δ1 based on the entire length of the sheet P and the setting of the sheet folding type of the sheet P. Further, the sheet folding device controller 50 determines the first projection amount Δ1 based on the function block of the control program executed by the sheet folding device controller 50.

When the leading end P01 of the sheet P has reached the position corresponding to the predetermined first projection amount Δ1, the sheet folding device controller 50 temporarily stops movement of the second sheet conveyor R2. Then, the sheet folding device controller 50 switches the rotational direction of the second sheet conveyor R2 to the reverse direction while continuously rotating the first sheet conveyor R1. That is, the sheet folding device controller 50 reverses the rotation of the second sheet conveyor R2 while rotating the first sheet conveyor R1 in the forward direction while the first sheet conveyor R1 and the second sheet conveyor R2 nip the sheet P.

Since the second sheet conveyor R2 including the pair of rollers shares one roller of the first sheet folder F1 including the pair of rollers, as illustrated in FIG. 8, the second sheet conveyor R2 temporarily stops and then rotates in the reverse direction, so that the leading end P01 of the sheet P is conveyed in the reverse direction (i.e., the upstream side in the sheet conveyance direction). On the other hand, the first sheet conveyor R1 continuously rotates in the rotational direction that is the same direction as the rotational direction as illustrated in FIGS. 6 and 7, the trailing end of the sheet P is continuously conveyed to the downstream side in the sheet conveyance direction.

Figure 9:
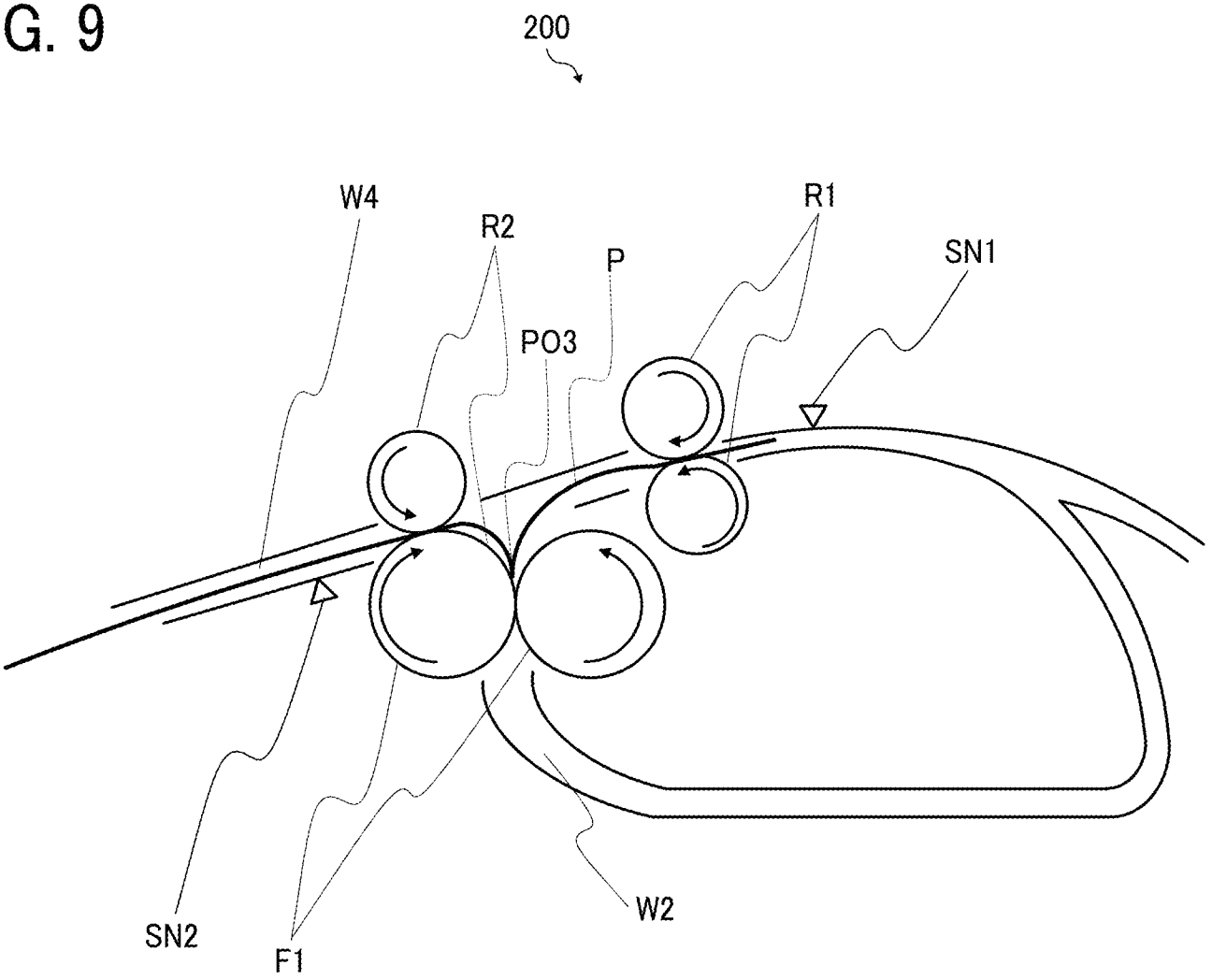
FIG. 9 is an enlarged view of the inner configuration of the sheet folding device according to the first embodiment, following FIG. 8.

FIG. 9 is an enlarged view of the inner configuration of the sheet folding device 200 according to the first embodiment, following FIG. 8.

As a result, as illustrated in FIG. 9, the sheet P warps or curves before the nip region of the first sheet folder F1. Then, the warped portion of the sheet P enters the nip region of the first sheet folder F1. As a result, as the sheet P enters the nip region of the first sheet folder F1, a fold is formed on the warped portion of the sheet P while the sheet P passes through the nip region.

Figure 10:
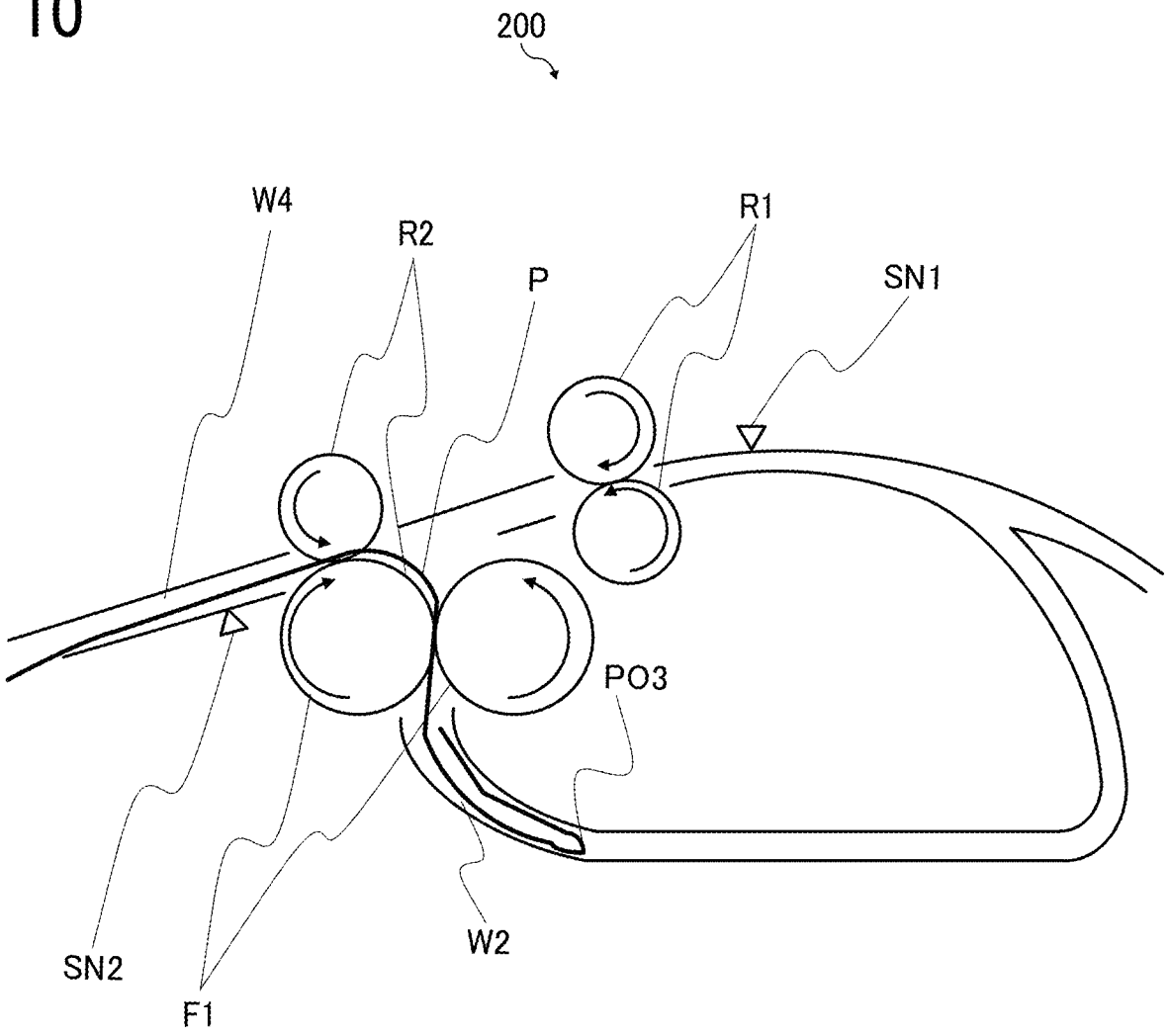
FIG. 10 is an enlarged view of the inner configuration of the sheet folding device according to the first embodiment, following FIG. 9.

FIG. 10 is an enlarged view of the inner configuration of the sheet folding device 200 according to the first embodiment, following FIG. 9.

With the above-described processes, the first folding operation is performed on the sheet P and, as illustrated in FIG. 10, a first fold P03 is formed on the sheet P. Then, the sheet P with the first fold P03 as the leading end is conveyed to the second sheet conveyance passage W2.

Figure 11:
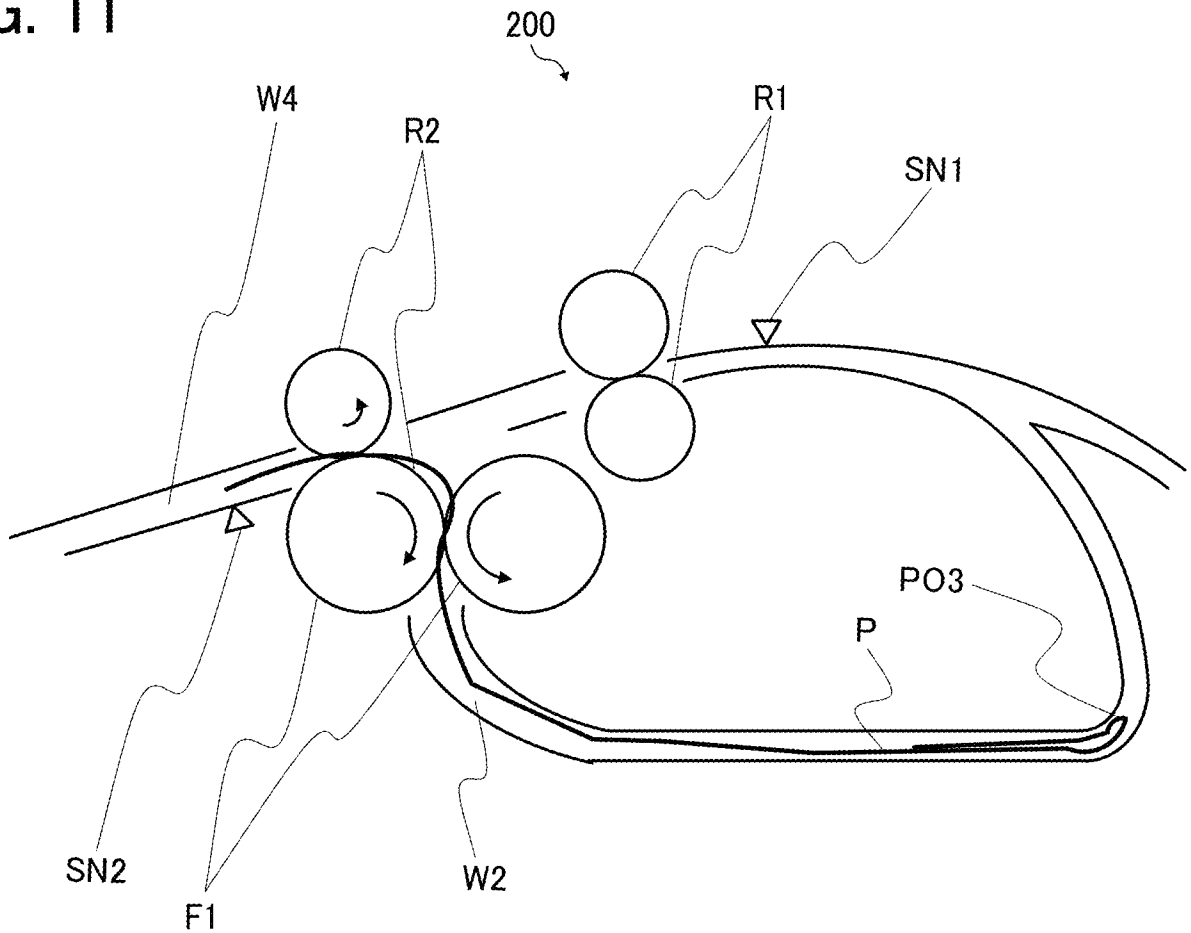
FIG. 11 is an enlarged view of the inner configuration of the sheet folding device according to the first embodiment, following FIG. 10.

FIG. 11 is an enlarged view of the inner configuration of the sheet folding device according to the first embodiment, following FIG. 10.

Then, the sheet P with the first fold P03 as the leading end is conveyed along the second sheet conveyance passage W2, as illustrated in FIG. 11. While the sheet P is conveyed as described above, the second sheet conveyor R2 continuously rotates in the reverse direction. Due to this operation, the sheet P travels along the second sheet conveyance passage W2, with the first fold P03 functioning as the leading end of the sheet P, and reaches the upstream side of the first sheet conveyor R1 in the first sheet conveyance passage W1.

Then, after the first folding operation is performed on the sheet P, the sheet P is conveyed as illustrated in FIGS. 5 and 6, to the downstream side by the first sheet conveyor R1 and the second sheet conveyor R2. Then, at the timing at which the leading end (i.e., the first fold P03) of the sheet P reaches the second sheet conveyor R2, the sheet folding device controller 50 switches the direction of rotation of the second sheet conveyor R2 from the reverse direction to the forward direction. As a result of this operation, the sheet P is conveyed to the downstream side in the sheet conveyance direction, by the first sheet conveyor R1 and the second sheet conveyor R2. Then, the first fold P03 reaches the position at which the second sheet detection sensor SN2 detects the sheet P.

Even after the second sheet detection sensor SN2 detected the first fold P03, the sheet folding device controller 50 causes the first sheet conveyor R1 and the second sheet conveyor R2 to continuously convey the sheet P. The sheet folding device controller 50 causes the first sheet conveyor R1 and the second sheet conveyor R2 to convey the sheet P to the downstream side in the sheet conveyance direction until the position of the first fold P03 of the sheet P reaches the position corresponding to a second projection amount Δ2 from the position of the second sheet detection sensor SN2.

Figure 12:
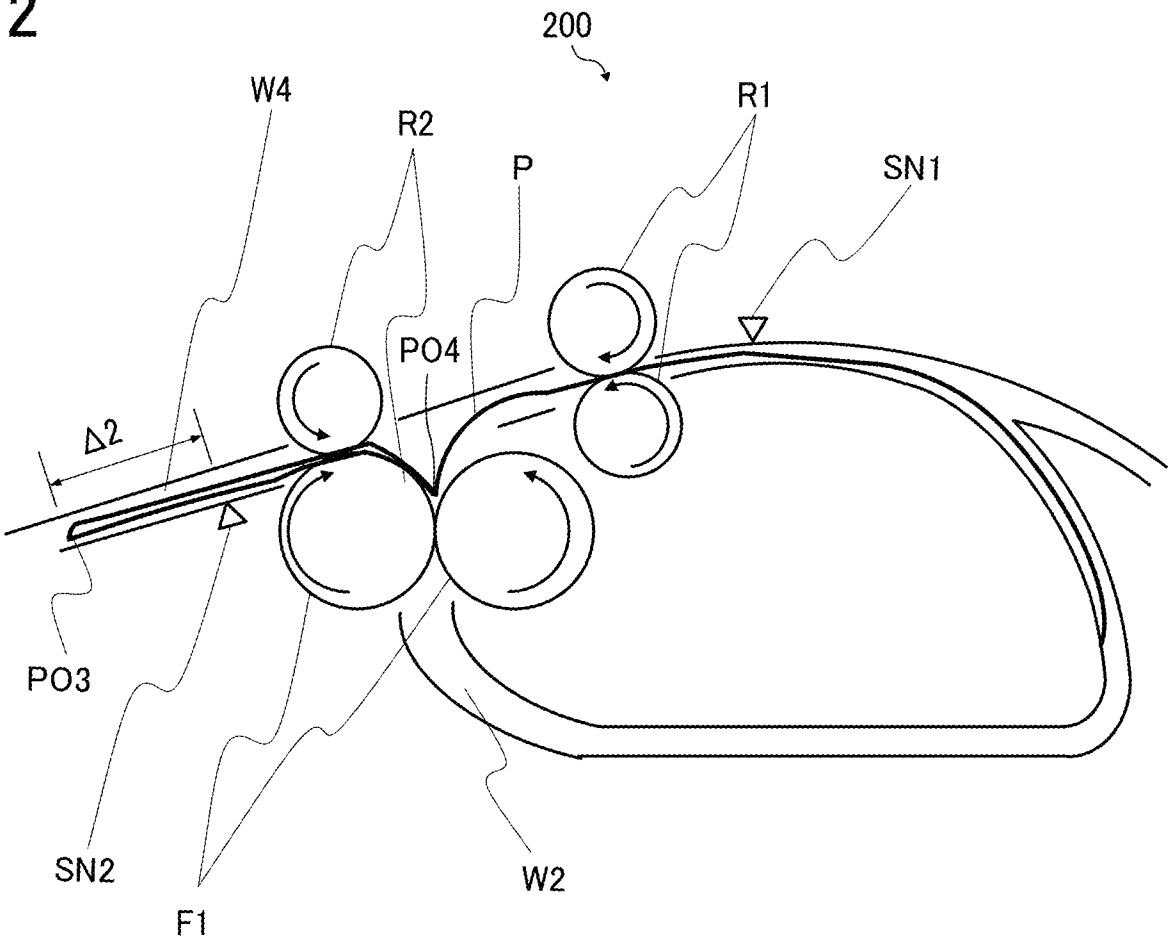
FIG. 12 is an enlarged view of the inner configuration of the sheet folding device according to the first embodiment, following FIG. 11.

FIG. 12 is an enlarged view of the inner configuration of the sheet folding device 200 according to the first embodiment, following FIG. 11.

When the sheet folding device controller 50 determines that the position of the first fold P03 of the sheet P reaches the position corresponding to the second projection amount Δ2 from the position of the second sheet detection sensor SN2, as described above with reference to FIG. 9, the sheet folding device controller 50 causes the second sheet conveyor R2 to stop as illustrated in FIG. 12. Thereafter, the sheet folding device controller 50 causes the second sheet conveyor R2 to rotate in the reverse direction. Note that the sheet folding device controller 50 causes the second sheet conveyor R2 to rotate in the reverse direction when the second projection amount Δ2 comes to the position corresponding to one half (½) of the entire length of the sheet P from the leading end P01 of the sheet P.

The sheet folding device controller 50 causes the second sheet conveyor R2 to rotate in the reverse direction and the first sheet conveyor R1 to continuously rotate in the forward direction. By so doing, as the second sheet conveyor R2 rotates in the reverse direction and the first sheet conveyor R1 rotate in the forward direction while the first sheet conveyor R1 and the second sheet conveyor R2 nip the sheet P in the respective nip regions, the sheet P warps (curves) before the nip region of the first sheet folder F1. Then, the warped portion of the sheet P enters the nip region of the first sheet folder F1. As a result, as the sheet P enters the nip region of the first sheet folder F1, a fold is formed on the warped portion of the sheet P while the sheet P passes through the nip region.

Figure 13:
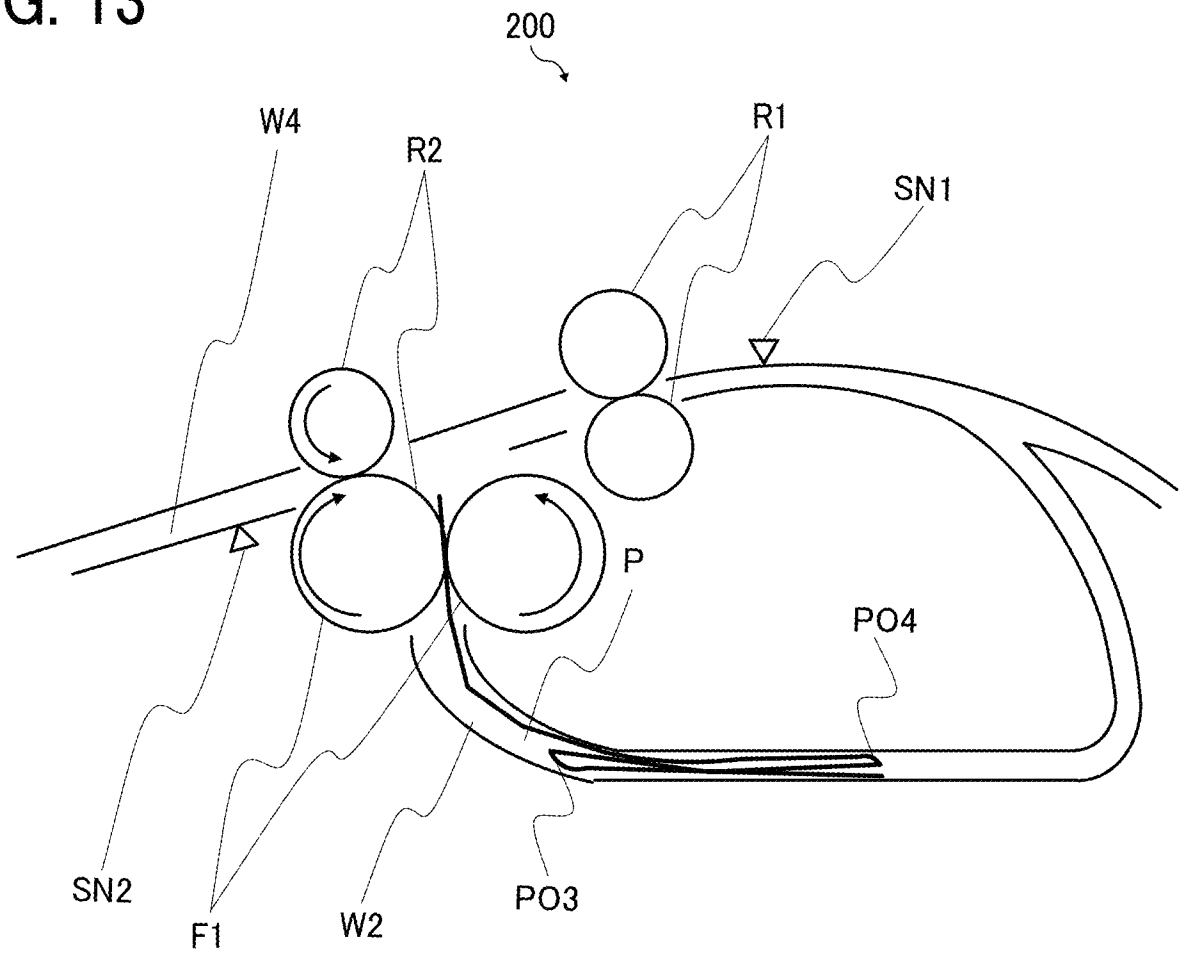
FIG. 13 is an enlarged view of the inner configuration of the sheet folding device according to the first embodiment, following FIG. 12.

FIG. 13 is an enlarged view of the inner configuration of the sheet folding device 200 according to the first embodiment, following FIG. 12.

With the above-described processes, the second folding operation is performed on the sheet P and, as illustrated in FIG. 13, two folds including the first fold P03 and a second fold P04 are formed on the sheet P. As a result, the sheet P is folded in a manner of Z-fold.

Note that, similar to the first projection amount Δ1, the sheet folding device controller 50 determines the second projection amount Δ2 based on the entire length of the sheet P and the setting of the sheet folding type of the sheet P. Accordingly, the sheet folding device controller 50 determines the second projection amount Δ2 based on the number of rotations of the second sheet conveyor R2 (that is, the number of steps of the drive motor).

As illustrated in FIG. 13, after the second folding operation is performed on the sheet P, the sheet P is conveyed by the second sheet conveyor R2 along the second sheet conveyance passage W2. Then, the sheet P passes the second sheet conveyance passage W2 and circulates to return to the first sheet conveyance passage W1. Thereafter, the first sheet conveyor R1 and the second sheet conveyor R2 convey the sheet P to the fourth sheet conveyance passage W4 that is disposed downstream from the second sheet conveyor R2 in the sheet conveyance direction. Then, the switching claw 23 guides the sheet P to the fifth sheet conveyance passage W5, so that the Z-folded sheet P is ejected to the sheet stacking tray 24 with the second fold P04 being the downstream end of the sheet P.

Overview of Half-Fold Operation

When the sheet folding device 200 performs the half-fold operation on a sheet P, the sheet P is folded out in the nip region of the first sheet folder F1 (first folding operation) at a position corresponding to one half (½) of the entire length of the sheet P from the leading end P01 of the sheet P in the sheet conveyance direction, as illustrated in FIG. 9. Then, the sheet P passes through the second sheet conveyance passage W2 that functions as a sheet circulation passage to return to the first sheet conveyance passage W1. At this time, the sheet folding device 200 does not perform the second folding operation on the sheet P. Then, the first sheet conveyor R1 and the second sheet conveyor R2 convey the sheet P without the second folding operation, to the fourth sheet conveyance passage W4.

Overview of Letter Fold-Out Operation

When the sheet folding device 200 performs the letter fold-out operation on a sheet P, the sheet P is folded outside in the nip region of the first sheet folder F1 (first folding operation) at a position corresponding to two thirds (⅔) of the entire length of the sheet P from the leading end P01 of the sheet P in the sheet conveyance direction, as illustrated in FIG. 9. Then, the sheet P passes through the second sheet conveyance passage W2 that functions as a sheet circulation passage to return to the first sheet conveyance passage W1. Then, when the sheet folding device controller 50 determines that the leading end of the sheet P, on which the first folding operation is performed, reaches the position corresponding to the second projection amount Δ2 from the position of the second sheet detection sensor SN2, the sheet folding device controller 50 causes the second sheet conveyor R2 to rotate in the reverse direction. Then, the sheet P is folded inside in the nip region of the first sheet folder F1 (second folding operation) at a position corresponding to two thirds (⅔) of the entire length of the sheet P from the leading end of the sheet P (that is, the first folded portion) in the sheet conveyance direction. Thereafter, the sheet P passes through the second sheet conveyance passage W2, the first sheet conveyance passage W1, and the fourth sheet conveyance passage W4, to the downstream side in the sheet conveyance direction.

Overview of Letter Fold-In Operation

When the sheet folding device 200 performs the letter fold-in operation on a sheet P, the sheet P is folded inside in the nip region of the first sheet folder F1 (first folding operation) at a position corresponding to two thirds (⅔) of the entire length of the sheet P from the leading end P01 of the sheet P in the sheet conveyance direction, as illustrated in FIG. 9. Then, the sheet P passes through the second sheet conveyance passage W2 that functions as a sheet circulation passage to return to the first sheet conveyance passage W1. Then, when the sheet folding device controller 50 determines that the leading end of the sheet P, on which the first folding operation is performed, reaches the position corresponding to the second projection amount Δ2 from the position of the second sheet detection sensor SN2, the sheet folding device controller 50 causes the second sheet conveyor R2 to rotate in the reverse direction. Then, the sheet P is folded inside in the nip region of the first sheet folder F1 (second folding operation) at a position corresponding to two thirds (⅔) of the entire length of the sheet P from the leading end of the sheet P (that is, the first folded portion) in the sheet conveyance direction. Thereafter, the sheet P passes through the second sheet conveyance passage W2, the first sheet conveyance passage W1, and the fourth sheet conveyance passage W4, to the downstream side in the sheet conveyance direction.

Another Overview of Z-fold Operation

Next, a description is given of the sheet folding device 200 according to another embodiment of the present disclosure, when the sheet folding device 200 performs the Z-fold on a sheet.

As described above in the conveyance control of the sheet P when the sheet folding device 200 performs the Z-fold operation, when the sheet folding device controller 50 determines that the position of the first fold P03 of the sheet P after the first folding operation reaches the position corresponding to one half (½) of the entire length of the sheet P, the sheet folding device controller 50 causes the second sheet conveyor R2 to temporarily stop and then rotate in the reverse direction. At the same time, the sheet folding device controller 50 causes the first sheet conveyor R1 to continuously rotate in the forward direction. By so doing, the sheet P is warped before the nip region of the first sheet folder F1 and conveyed to the nip region of the first sheet folder F1 (see FIG. 12). Accordingly, the second folding operation is performed on the sheet P, so that the second fold P04 is formed.

In the present embodiment, the sheet folding device controller 50 causes the second sheet conveyor R2 (the first sheet folder F1) to temporarily stop the rotation and then rotate in the reverse direction, at a timing between the state illustrated in FIG. 12 and the state illustrated in FIG. 13. The sheet folding device controller 50 determines the state in which the sheet P is nipped in the nip region of the first sheet folder F1, based on the number of rotations of the second sheet conveyor R2 (that is, the number of steps of the drive motor), after the second folding operation is performed on the sheet P. Then, the sheet folding device controller 50 causes the first sheet folder F1 to stop and then rotate in the reverse direction before the trailing end of the sheet P passes through and exits the nip region of the first sheet folder F1.

As a result of this operation, the trailing edge of the sheet P (the opposite end opposite to the second fold P04 when the second fold P04 is the leading end) directs the nip region of the second sheet conveyor R2. Thereafter, the second sheet conveyor R2 conveys the sheet P to the fourth sheet conveyance passage W4.

Figure 14:
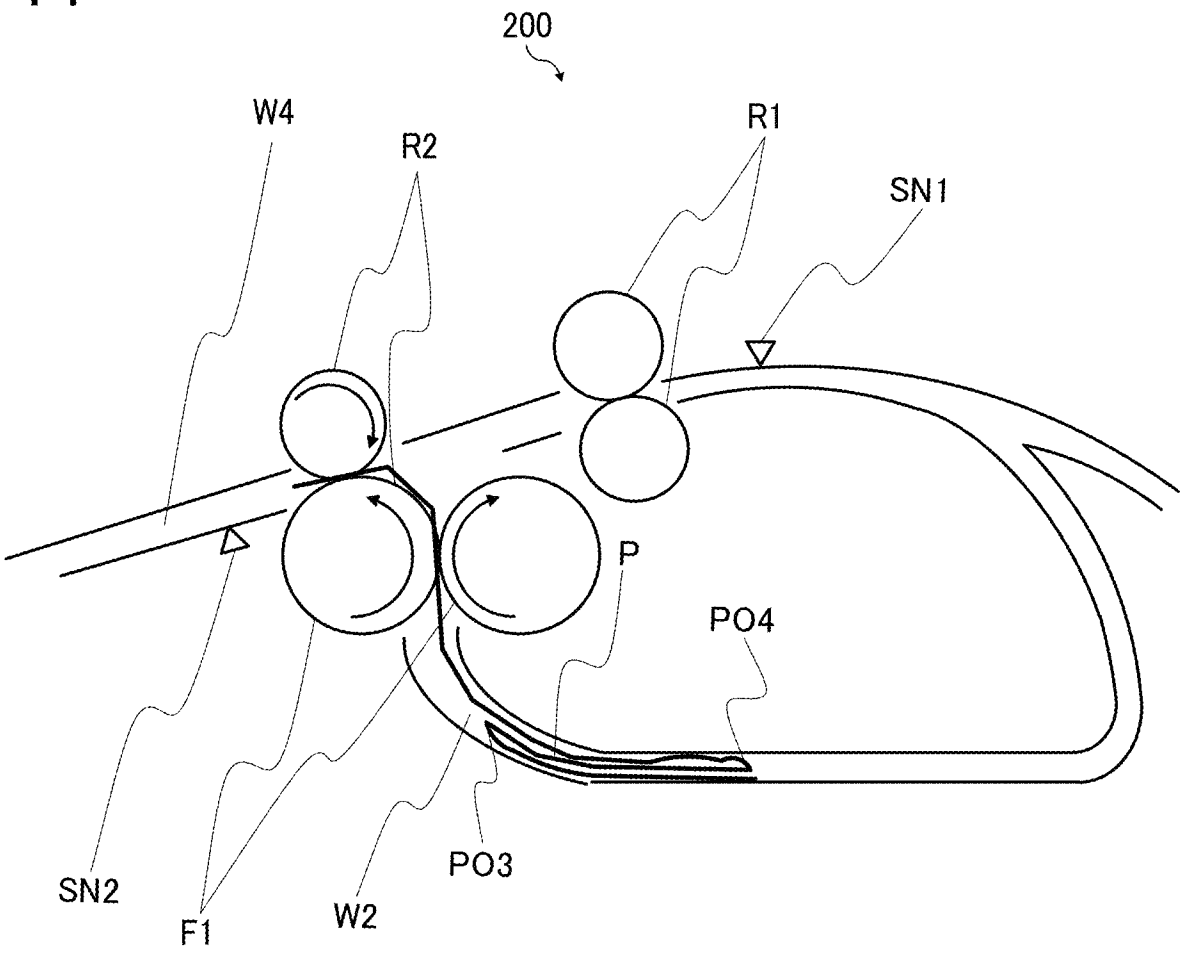
FIG. 14 is an enlarged view of the inner configuration of the sheet folding device according to the first embodiment, following FIG. 13.

FIG. 14 is an enlarged view of the inner configuration of the sheet folding device 200 according to the first embodiment, following FIG. 13.

As the second sheet conveyor R2 (the first sheet folder F1) rotates in the reverse direction from the state illustrated in FIG. 14, the first fold P03 and the second fold P04 pass through the nip region of the first sheet folder F1 in the reverse direction. Accordingly, the first fold P03 and the second fold P04 are additionally folded in the nip region of the first sheet folder F1.

As described above, the sheet folding device controller 50 causes the Z-folded sheet P not to be circulated in the first sheet conveyance passage W1 via the second sheet conveyance passage W2 after the second sheet folding operation but to be reversed in the second sheet conveyance passage W2. Thereafter, the second sheet conveyor R2 conveys the sheet P to pass through the fourth sheet conveyance passage W4 with the non-folded end of the sheet P being as the leading end (downstream end). Then, the sheet P is ejected to the sheet stacking tray 24. When the sheet P is ejected to the sheet stacking tray 24, the second fold P04 of the sheet P is located on the root end of the sheet stacking tray 24. That is, the sheets P are stacked and accumulated on the sheet stacking tray 24, with the thicker portion of each sheet P being stacked in the lower portion of inclination of the sheet stacking tray 24.

Note that, as illustrated in FIG. 3, the sheet stacking tray 24 is inclined downward toward the root end. In a case in which the Z-folded sheets P are stacked on the sheet stacking tray 24, the second fold P04 that is the thicker portion of the sheet P is preferably stacked on the root end of the sheet stacking tray 24. By so doing, the upper face of the uppermost sheet P of the accumulated sheets P has an inclination having an angle smaller than the angle of inclination of the sheet stacking tray 24. In other words, the inclination of the upper face of the uppermost sheet P is substantially horizontal.

Since the Z-folded sheets P are stacked on the sheet stacking tray 24 in this state, the number of sheets P stackable on the sheet stacking tray 24 of the sheet folding device 200 is greater than the number of sheets stackable on the tray of a comparative sheet folding device. Accordingly, this configuration of the sheet folding device 200 restrains a decrease in the amount (number) of the Z-folded sheets P actually stackable on the sheet stacking tray 24 to the maximum amount of stackable sheets on the sheet stacking tray 24.

Operation Flow of Sheet Folding Device 200

Figure 15:
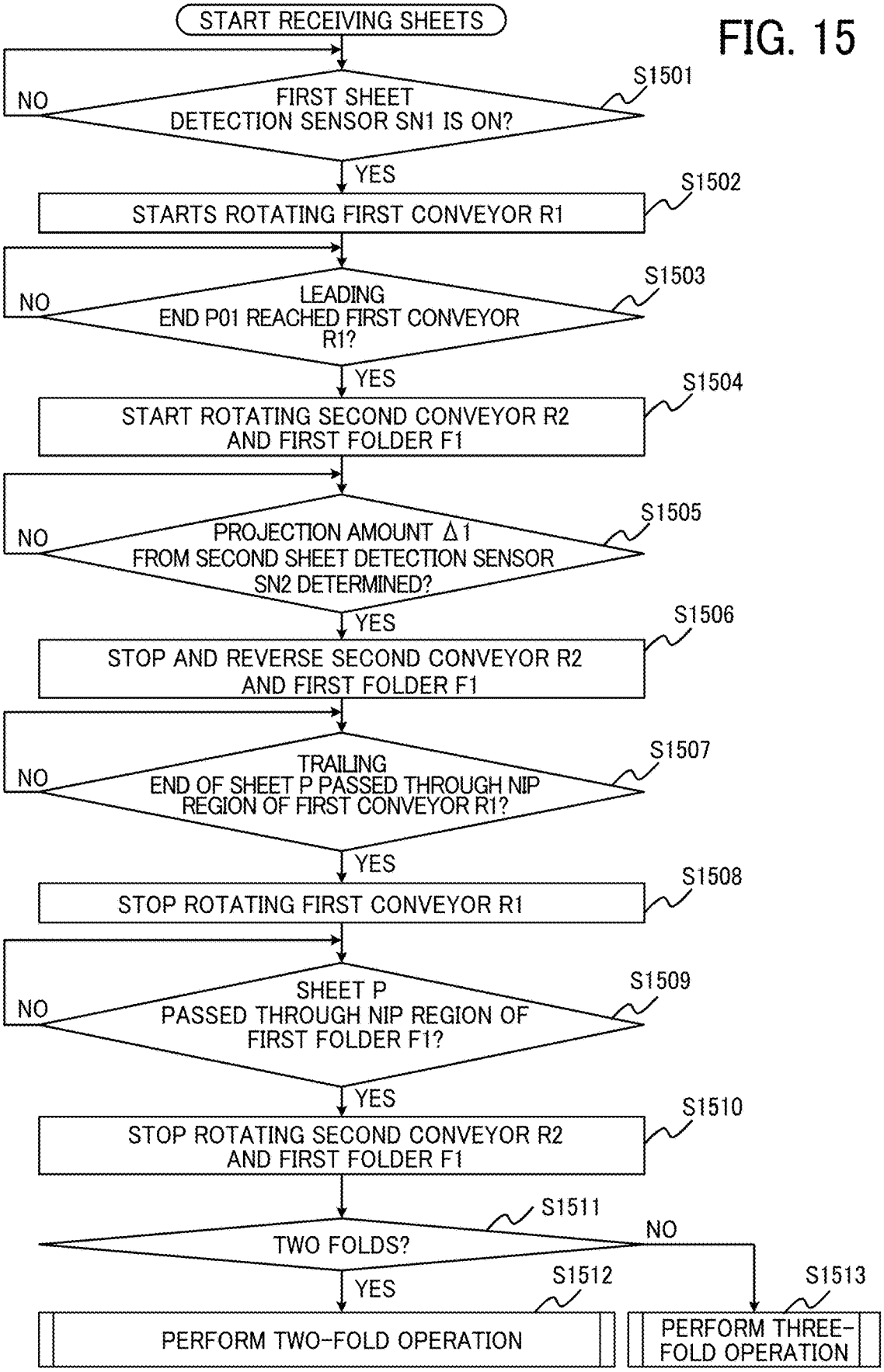
FIG. 15 is a flowchart of a flow of a sheet folding operation performed by the sheet folding device.
Figure 16:
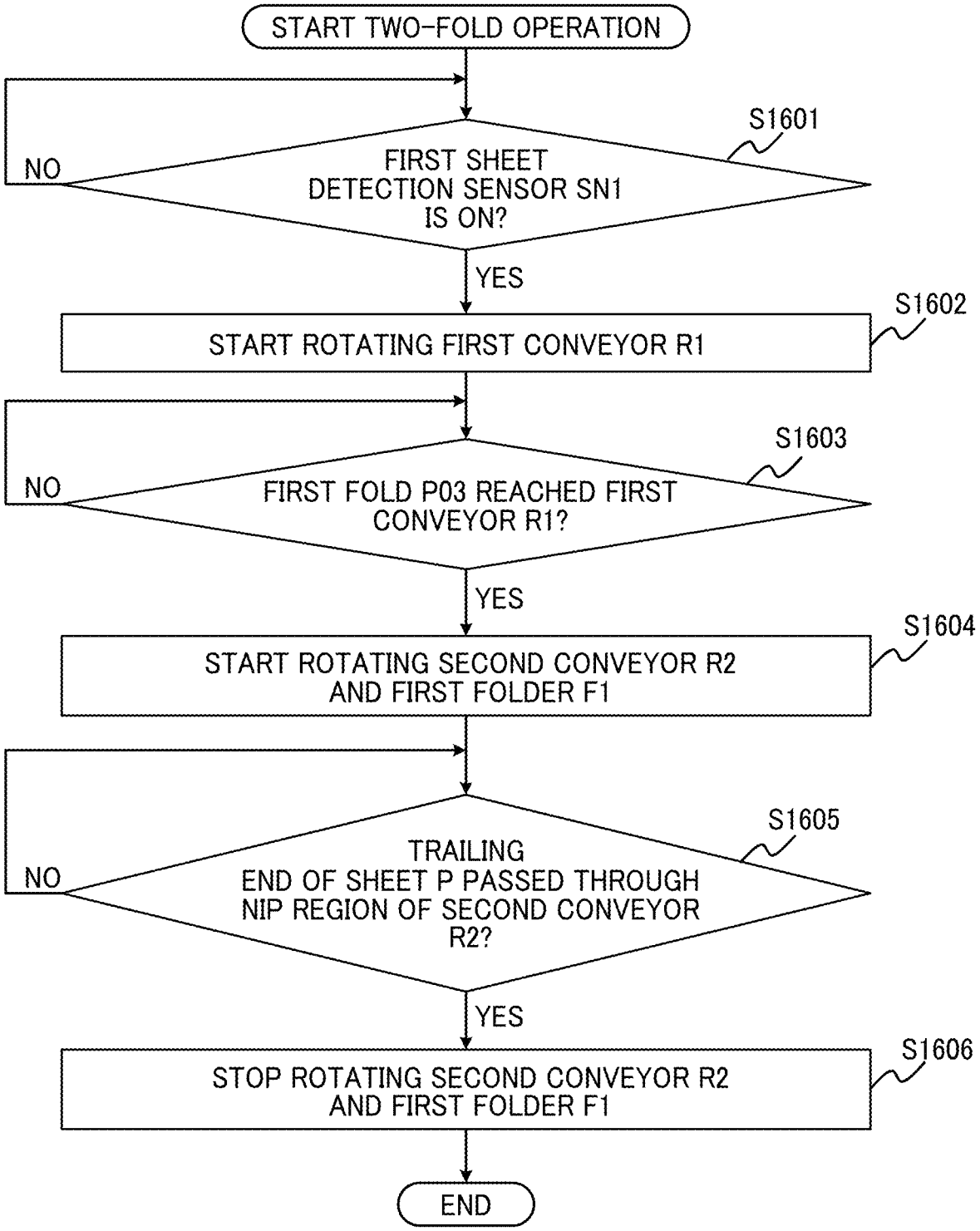
FIG. 16 is a flowchart of a flow of a sheet folding operation performed by the sheet folding device, following the flow of FIG. 15.

Next, a description is given of the operation flow of the sheet folding device 200 according to the present embodiment, with reference to the flowcharts of FIGS. 15 to 17.

FIG. 15 is a flowchart of a flow of a sheet folding operation performed by the sheet folding device 200.

First, as the sheet folding device controller 50 starts receiving the sheet P from the image forming apparatus 100, the sheet folding device controller 50 determines whether the first sheet detection sensor SN1 detects the sheet P and wait that the first sheet detection sensor SN1 is turned ON (step S1501). When the first sheet detection sensor SN1 does not detect the sheet P, that is, the first sheet detection sensor SN1 is not turned ON (NO in step S1501), step S1501 is repeated until the first sheet detection sensor SN1 is turned ON. On the other hand, the first sheet detection sensor SN1 detects the sheet P, that is, the first sheet detection sensor SN1 is turned on (YES in step S1501), the sheet folding device controller 50 starts rotating the first sheet conveyor R1 (step S1502).

Then, the sheet folding device controller 50 determines whether the leading end P01 of the sheet P has reached the first sheet conveyor R1, based on the elapsed time from when the first sheet detection sensor SN1 is turned ON (step S1503). When the leading end P01 of the sheet P has not reached the first sheet conveyor R1 (NO in step S1503), step S1503 is repeated until the leading end P01 of the sheet P reaches the first sheet conveyor R1. On the other hand, when the sheet folding device controller 50 determines that the leading end P01 of the sheet P has reached the first sheet conveyor R1 (YES in step S1503), the sheet folding device controller 50 start rotating the second sheet conveyor R2 (the first sheet folder F1) (step S1504).

After the second sheet detection sensor SN2 has detected the leading end P01 of the sheet P, the sheet folding device controller 50 determines the projection amount of the leading end P01 of the sheet P from the second sheet detection sensor SN2, based on the rotation amount of the second sheet conveyor R2 from when the second sheet detection sensor SN2 has detected the leading end P01 of the sheet P (step S1505). Then, when the sheet folding device controller 50 determines whether the projection amount of the leading end P01 of the sheet P from the second sheet detection sensor SN2 has reached the first projection amount Δ1 (S1505). When the projection amount of the leading end P01 of the sheet P has not reached the first projection amount Δ1 (NO in S1505), step S1505 is repeated until the leading end P01 of the sheet P reaches the first projection amount Δ1. On the other hand, when the projection amount of the leading end P01 of the sheet P has reached the first projection amount Δ1 (YES in S1505), the sheet folding device controller 50 causes the second sheet conveyor R2 (the first sheet folder F1) to reverse, in other words, rotate in the reverse direction (step S1506).

Thereafter, the sheet folding device controller 50 determines whether the trailing end of the sheet P passes through the nip region of the first sheet conveyor R1 (step S1507). When the trailing end of the sheet P has not passed through the nip region of the first sheet conveyor R1 (NO in step S1507), step S1507 is repeated until the trailing end of the sheet P passes through the nip region of the first sheet conveyor R1. On the other hand, when trailing end of the sheet P has passed through the nip region of the first sheet conveyor R1 (YES in step S1507), the sheet folding device controller 50 causes the first sheet conveyor R1 to stop rotating (step S1508). Then, as the second sheet conveyor R2 (the first sheet folder F1) rotates, the sheet P is conveyed along the second sheet conveyance passage W2. Then, the sheet folding device controller 50 determines whether the sheet P passes through the nip region of the first sheet folder F1 (step S1509). When the sheet P has not passed through the nip region of the first sheet folder F1 (NO in step S1509), step S1509 is repeated until the sheet P passes through the nip region of the first sheet folder F1. On the other hand, when the sheet P has passed through the nip region of the first sheet folder F1 (YES in step S1509), the sheet folding device controller 50 causes the second sheet conveyor R2 (the first sheet folder F1) to stop rotating (step S1510).

Thereafter, the sheet folding device controller 50 determines whether the type of the specified sheet folding operation is a half-fold operation (step S1511). When the type of the specified sheet folding operation is a half-fold (two-fold) operation (YES in step S1511), the sheet folding device controller 50 performs a two-fold operation (step S1512). When the type of the specified sheet folding operation is not a half-fold (two-fold) operation (NO in step S1511), the sheet folding device controller 50 determines the type of the specified sheet folding operation is a three-fold operation and performs the three-fold operation (step S1513).

Now, a detailed description is given of the half-fold (two-fold) operation (step S1512), with reference to the flowchart of FIG. 16.

FIG. 16 is a flowchart of a flow of a sheet folding operation performed by the sheet folding device 200, following the flow of FIG. 15.

First, as the sheet P is conveyed back to the first sheet conveyance passage W1 via the second sheet conveyance passage W2, the sheet folding device controller 50 determines whether the first sheet detection sensor SN1 detects the first fold P03 of the sheet P, that is, the first sheet detection sensor SN1 is turned ON (step S1601). When the first sheet detection sensor SN1 has not detected the first fold P03 of the sheet P, that is, the first sheet detection sensor SN1 is not turned ON (NO in step S1601), step S1601 is repeated until the first sheet detection sensor SN1 detects the first fold P03 of the sheet P and is turned ON. On the other hand, when the first sheet detection sensor SN1 has detected the first fold P03 of the sheet P, that is, the first sheet detection sensor SN1 is turned ON (YES step S1601), the sheet folding device controller 50 causes the first sheet conveyor R1 to start rotating (step S1602).

Then, the sheet folding device controller 50 determines whether the first fold P03 of the sheet P has reached the first sheet conveyor R1 (step S1603). When the first fold P03 of the sheet P has not reached the first sheet conveyor R1 (NO in step S1603), step S1603 is repeated until the first fold P03 of the sheet P reaches the first sheet conveyor R1. On the other hand, when the first fold P03 of the sheet P has reached the first sheet conveyor R1 (YES in step S1603), the sheet folding device controller 50 causes the second sheet conveyor R2 (the first sheet folder F1) to start rotating (step S1604). Thereafter, the sheet folding device controller 50 determines whether the trailing end of the sheet P passes through the nip region of the second sheet conveyor R2 (step S1605). When the trailing end of the sheet P has not passed through the nip region of the second sheet conveyor R2 (NO in step S1605), step S1605 is repeated until the trailing end of the sheet P passes through the nip region of the second sheet conveyor R2. On the other hand, when trailing end of the sheet P has passed through the nip region of the second sheet conveyor R2 (YES in step S1605), the sheet folding device controller 50 causes the second sheet conveyor R2 (the first sheet folder F1) to stop rotating (step S1606). Accordingly, the half-fold (two-fold) operation is finished, and the flow of the half-fold (two-fold) operation ends.

Now, a detailed description is given of the three-fold operation (step S1513), with reference to the flowchart of FIG. 17.

FIG. 17 is a flowchart of a flow of a sheet folding operation performed by the sheet folding device 200, following the flow of FIG. 15.

First, as the sheet P is conveyed back to the first sheet conveyance passage W1 via the second sheet conveyance passage W2, the sheet folding device controller 50 determines whether the first sheet detection sensor SN1 detects the first fold P03 of the sheet P, that is, the first sheet detection sensor SN1 is turned ON (step S1701). When the first sheet detection sensor SN1 has not detected the first fold P03 of the sheet P, that is, the first sheet detection sensor SN1 is not turned ON (NO in step S1701), step S1601 is repeated until the first sheet detection sensor SN1 detects the first fold P03 of the sheet P and is turned ON. On the other hand, when the first sheet detection sensor SN1 has detected the first fold P03 of the sheet P, that is, the first sheet detection sensor SN1 is turned ON (YES step S1701), the sheet folding device controller 50 causes the first sheet conveyor R1 to start rotating (step S1702).

Then, the sheet folding device controller 50 determines whether the first fold P03 of the sheet P has reached the first sheet conveyor R1 (step S1703). When the first fold P03 of the sheet P has not reached the first sheet conveyor R1 (NO in step S1703), step S1603 is repeated until the first fold P03 of the sheet P reaches the first sheet conveyor R1. On the other hand, when the first fold P03 of the sheet P has reached the first sheet conveyor R1 (YES in step S1703), the sheet folding device controller 50 causes the second sheet conveyor R2 (the first sheet folder F1) to start rotating (step S1704).

After the second sheet detection sensor SN2 has detected the leading end P01 of the sheet P, the sheet folding device controller 50 determines the projection amount of the leading end P01 of the sheet P from the second sheet detection sensor SN2, based on the rotation amount of the second sheet conveyor R2 from when the second sheet detection sensor SN2 has detected the leading end P01 of the sheet P (step S1705). Then, when the sheet folding device controller 50 determines whether the projection amount of the leading end P01 of the sheet P from the second sheet detection sensor SN2 reaches the second projection amount Δ2 (S1705). When the projection amount of the leading end P01 of the sheet P has not reached the second projection amount Δ2 (NO in S1705), step S1705 is repeated until the leading end P01 of the sheet P reaches the second projection amount Δ2. On the other hand, when the projection amount of the leading end P01 of the sheet P has reached the second projection amount Δ2 (YES in S1705), the sheet folding device controller 50 causes the second sheet conveyor R2 (the first sheet folder F1) to reverse, in other words, rotate in the reverse direction (step S1706).

Thereafter, the sheet folding device controller 50 determines whether the trailing end of the sheet P passes through the nip region of the first sheet conveyor R1 (step S1707). When the trailing end of the sheet P has not passed through the nip region of the first sheet conveyor R1 (NO in step S1707), step S1707 is repeated until the trailing end of the sheet P passes through the nip region of the first sheet conveyor R1. On the other hand, when trailing end of the sheet P has passed through the nip region of the first sheet conveyor R1 (YES in step S1707), the sheet folding device controller 50 causes the first sheet conveyor R1 to stop rotating (step S1708). Then, the sheet folding device controller 50 causes the sheet P with the first fold P03 and the second fold P04 to be conveyed by a specified distance (step S1709), and then causes the second sheet conveyor R2 (the first sheet folder F1) to stop rotating, and then reverse, in other words, rotate in the reverse direction (step S1710).

Then, the sheet folding device controller 50 determines whether the sheet P passes through the nip region of the second sheet conveyor R2 (step S1711). When the sheet P has not passed through the nip region of the second sheet conveyor R2 (NO in step S1711), step S1711 is repeated until the sheet P passes through the nip region of the second sheet conveyor R2. On the other hand, when the sheet P has passed through the nip region of the second sheet conveyor R2 (YES in step S1711), the sheet folding device controller 50 causes the second sheet conveyor R2 (the first sheet folder F1) to stop rotating (step S1712).

Accordingly, the half-fold (two-fold) operation is finished, and the flow of the three-fold operation ends.

Second Embodiment of Sheet Folding Device 200

Next, a description is given of the sheet folding device 200 according to a second embodiment of the present disclosure.

Figure 18:
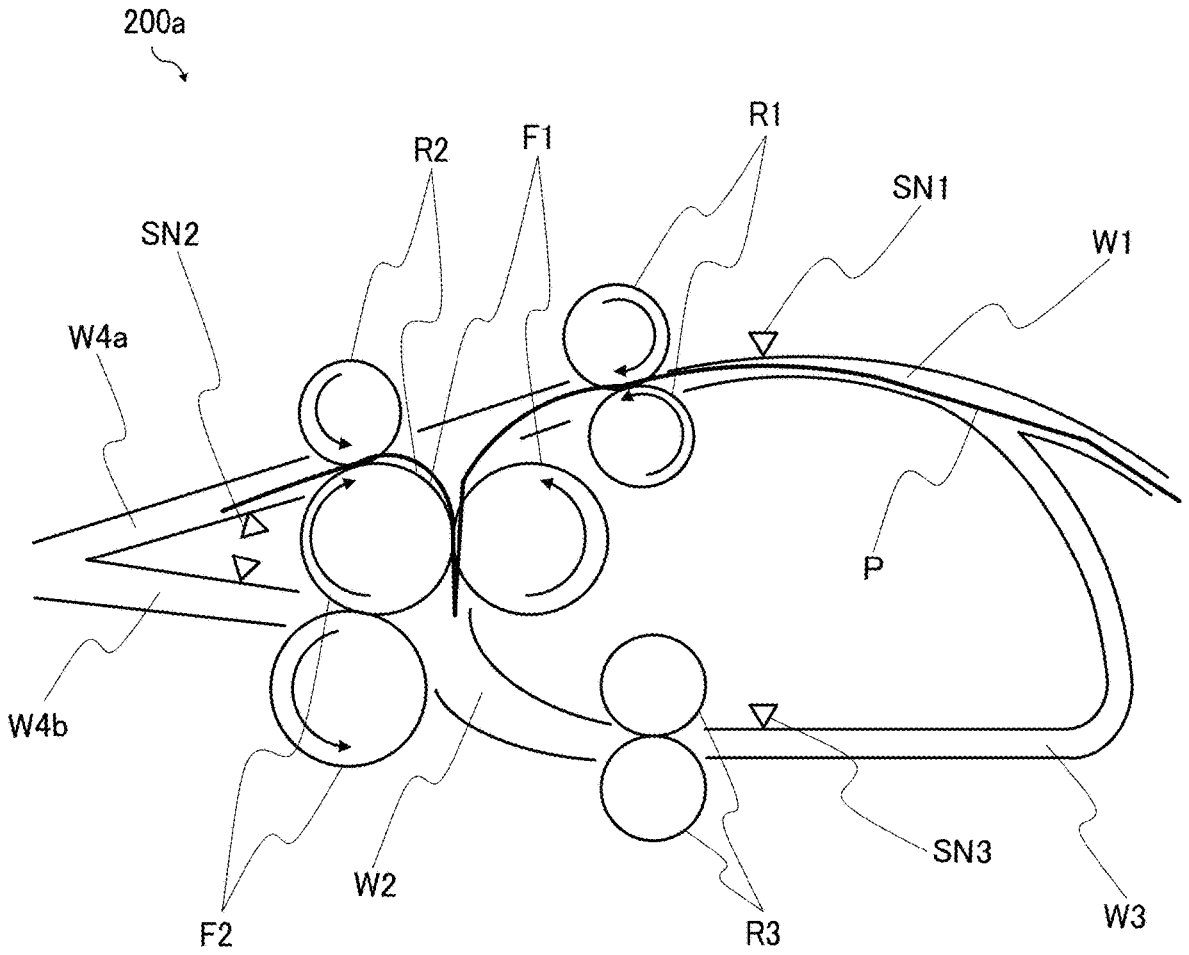
FIG. 18 is an enlarged view of the inner configuration of the sheet folding device according to a second embodiment.

FIG. 18 is a diagram illustrating a schematic inner configuration of a sheet folding device 200*a* according to a second embodiment.

Similar to the sheet folding device 200 according to the second embodiment of the present disclosure, the sheet folding device 200*a* includes a plurality of sheet conveyance passages. Further, in addition to the plurality of sheet conveyance passages in the sheet folding device 200 according to the first embodiment, the sheet folding device 200*a* further includes a third sheet conveyance passage W3.

The sheet folding device 200*a* further includes a third sheet conveyor R3. The third sheet conveyance passage W3 is extended following the second sheet conveyance passage W2 downstream from the first sheet folder F1 in the sheet conveyance direction and is located opposite the second sheet conveyance passage W2 across the third sheet conveyor R3. Then, the third sheet conveyance passage W3 meets the first sheet conveyance passage W1 upstream from the first sheet conveyor R1 in the sheet conveyance direction.

The third sheet conveyor R3 is a pair of sheet conveyance rollers disposed facing each other between the second sheet conveyance passage W2 and the third sheet conveyance passage W3. The third sheet conveyor R3 also has a pair of rollers and forms a nip region between the pair of rollers. A third sheet detection sensor SN3 is disposed immediately after (downstream) the third sheet conveyor R3 in the sheet conveyance passage in the third sheet conveyance passage W3. The third sheet detection sensor SN3 detects the sheet P passing through the third sheet conveyance passage W3 and notifies the detection signal to the sheet folding device controller 50.

Further, in addition to the sheet folding device 200, the sheet folding device 200*a* further includes a second sheet folder F2 and a fourth sheet conveyance passage W4*b* downstream from the second sheet folder F2 in the sheet conveyance direction. Note that a fourth sheet conveyance passage W4*a* of the sheet folding device 200*a* shares the same sheet conveyance passage as the fourth sheet conveyance passage W4 of the sheet folding device 200, and therefore the same passage as the fourth sheet conveyance passage W4 is represented as the fourth sheet conveyance passage W4*a*, for convenience. The fourth sheet conveyance passage W4*a* and the fourth sheet conveyance passage W4*b* meet at a downstream point, forming the fourth sheet conveyance passage W4, similar to the sheet folding device 200. The sheet folding device 200*a* performs the Z-fold operation on the leading end of the sheet P, without using the sheet circulation passage.

Now, a description is given of the flow of the operation of the sheet folding device 200*a*.

Note that the flow of the sheet folding device 200*a* is same as the flow of the sheet folding device 200, before the first folding operation.

Figure 19:
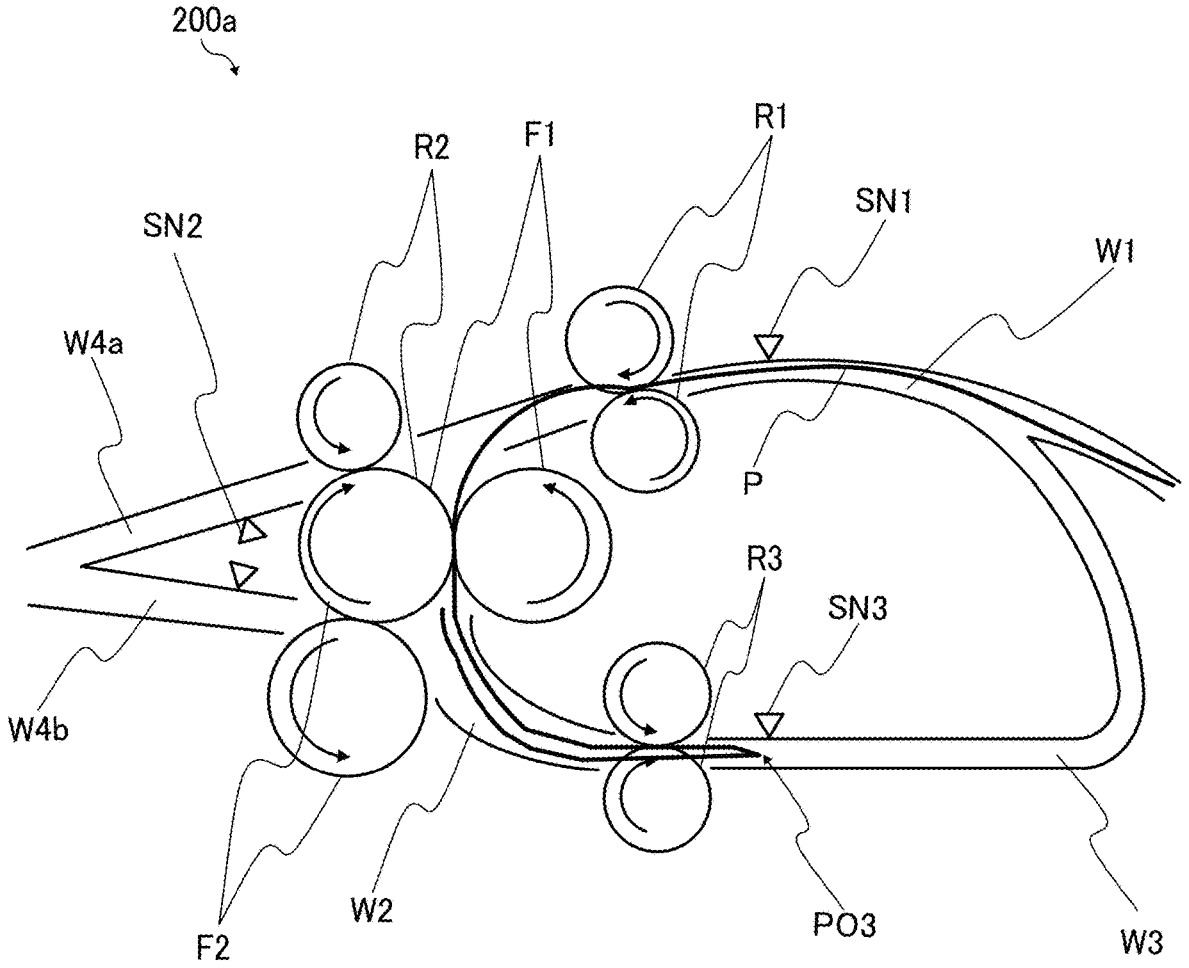
FIG. 19 is an enlarged view of the inner configuration of the sheet folding device according to the second embodiment, following FIG. 18.

FIG. 19 is an enlarged view of the inner configuration of the sheet folding device 200*a* according to the second embodiment, following FIG. 18.

After the first folding operation is performed on the sheet P, the sheet P is conveyed to the second sheet conveyance passage W2, as illustrated in FIG. 18. The sheet P is conveyed along the downward slope of the second sheet conveyance passage W2. Further, as illustrated in FIG. 19, the sheet P is nipped in the nip region of the third sheet conveyor R3 that has started rotation in the direction indicated by arrow in FIG. 19 and is conveyed toward the third sheet conveyance passage W3.

Then, when the third sheet detection sensor SN3 detects the first fold P03 as the leading end of the sheet P in the sheet conveyance direction, the third sheet detection sensor SN3 sends the detection signal to notify the sheet folding device controller 50. After the detection signal is sent from the third sheet detection sensor SN3 to notify the sheet folding device controller 50, the sheet folding device controller 50 causes the third sheet conveyor R3 to continuously rotate and further convey the sheet P to the third sheet conveyance passage W3. Then, the sheet folding device controller 50 determines whether the first fold P03 of the sheet P reaches a position that corresponds to the third projection amount Δ3 from the third sheet detection sensor SN3.

Similar to the first projection amount Δ1, the sheet folding device controller 50 determines the third projection amount Δ3 based on the entire length of the sheet P and the setting of the sheet folding type of the sheet P. The sheet folding device controller 50 determines whether the projection amount of the first fold P03 has reached the third projection amount Δ3, based on the rotation amount of the third sheet conveyor R3 (that is, the number of drive steps of the drive motor).

Figure 20:
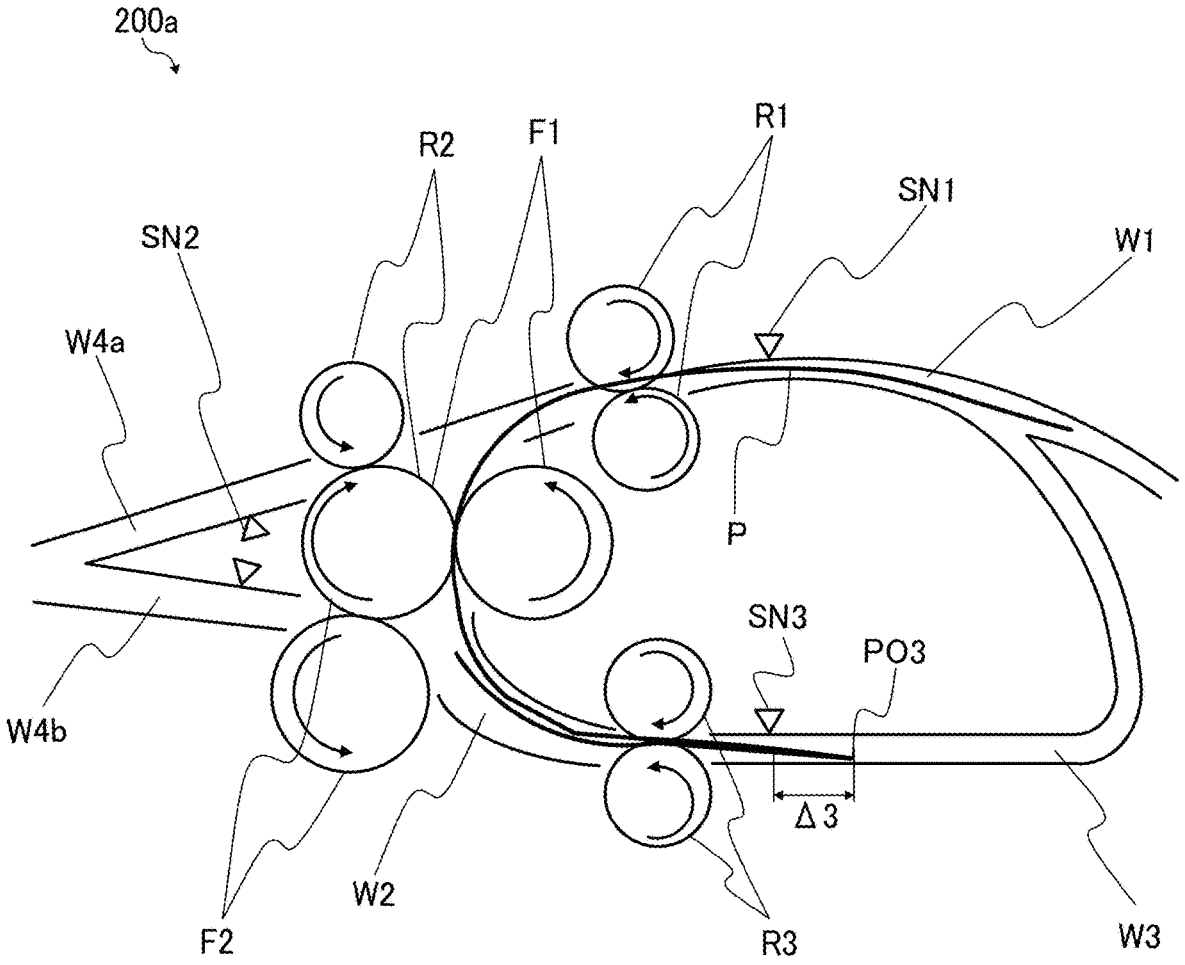
FIG. 20 is an enlarged view of the inner configuration of the sheet folding device according to the second embodiment, following FIG. 19.

FIG. 20 is an enlarged view of the inner configuration of the sheet folding device 200*a* according to the second embodiment, following FIG. 19.

As illustrated in FIG. 20, when the projection amount of the first fold P03 from the third sheet detection sensor SN3 reaches the third projection amount Δ3, the sheet folding device controller 50 causes the third sheet conveyor R3 to temporarily stop and then reverse, in other words, rotate in the reverse direction. Further, the sheet folding device controller 50 causes the third sheet conveyor R3 to reverse, in other words, rotate in the reverse direction, in a state in which the second sheet conveyor R2 (the first sheet folder F1) continuously rotate in the direction indicated by arrows in FIGS. 18 and 19. At this time, the first sheet conveyor R1, the second sheet conveyor R2, the first sheet folder F1, and the third sheet conveyor R3 nip the sheet P. By so doing, the sheet P is warped in the second sheet conveyance passage W2 downstream from the nip region of the first sheet folder F1, as illustrated in FIG. 21.

Figure 21:
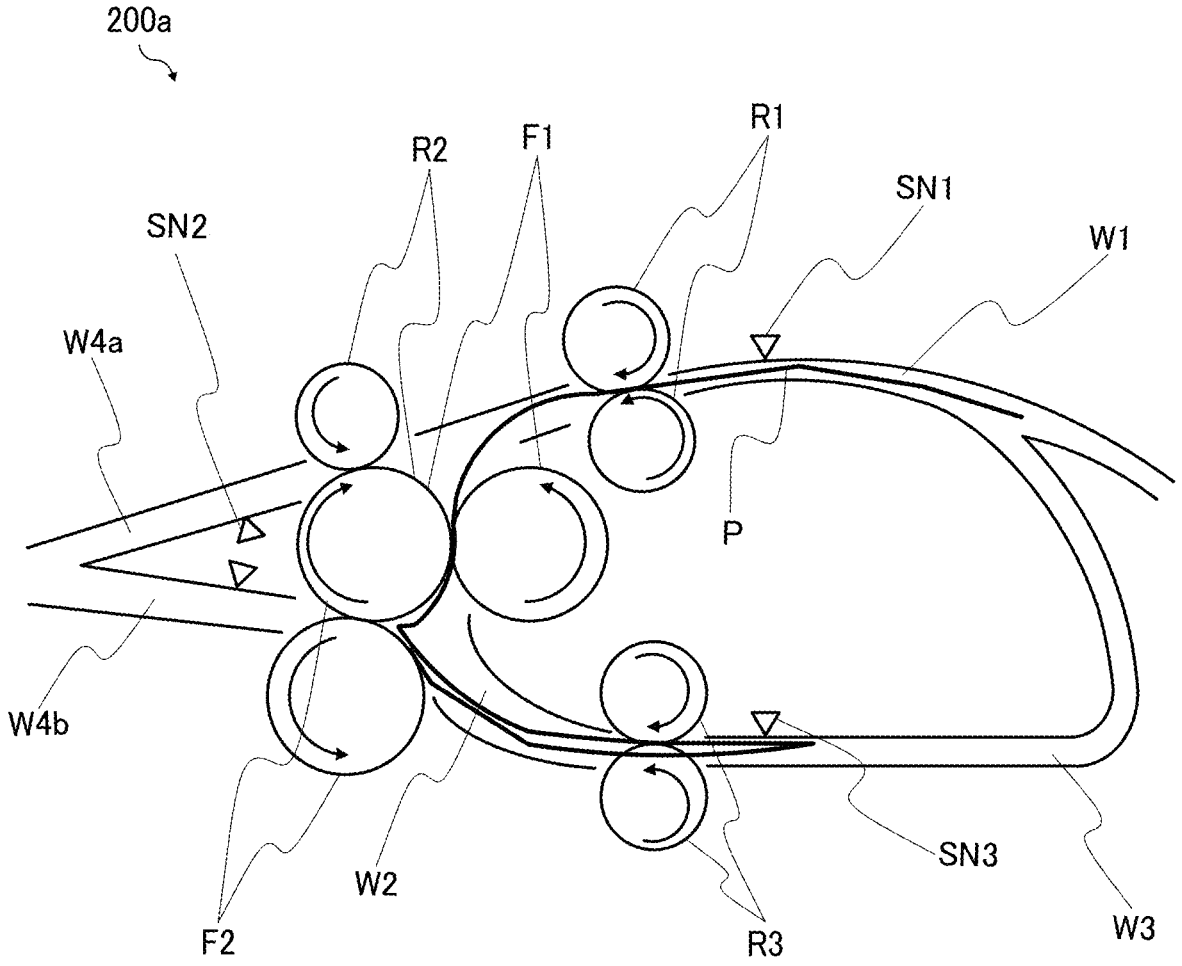
FIG. 21 is an enlarged view of the inner configuration of the sheet folding device according to the second embodiment, following FIG. 20.

FIG. 21 is an enlarged view of the inner configuration of the sheet folding device 200*a* according to the second embodiment, following FIG. 20.

Then, when the sheet folding device controller 50 causes the second sheet conveyor R2 and the third sheet conveyor R3 to continuously drive and rotate in the direction indicated by arrows in FIG. 21, the warped portion of the sheet P enters the nip region of the second sheet folder F2. Then, after the second fold P04 is formed on the sheet P by the nip region of the second sheet folder F2, the sheet P is conveyed from the second sheet conveyance passage W2 to the fourth sheet conveyance passage W4*b*. The sheet P on which the second folding operation is performed is further conveyed to the fourth sheet conveyance passage W4*b* and the fifth sheet conveyance passage W5 and is eventually ejected to the sheet stacking tray 24.

As described above, the sheet folding device 200*a* according to the present embodiment performs the Z-fold operation on the sheet P to form a fold as the leading end without using the sheet circulation passage. Therefore, the productivity of the sheet folding device 200*a* increases.

Relation of Imposition and Sheet Folding Method

Next, a description is given of the relation of imposition of images on the sheet P and the sheet folding method, in the sheet folding device 200 and the sheet folding device 200*a*.

Figure 22:
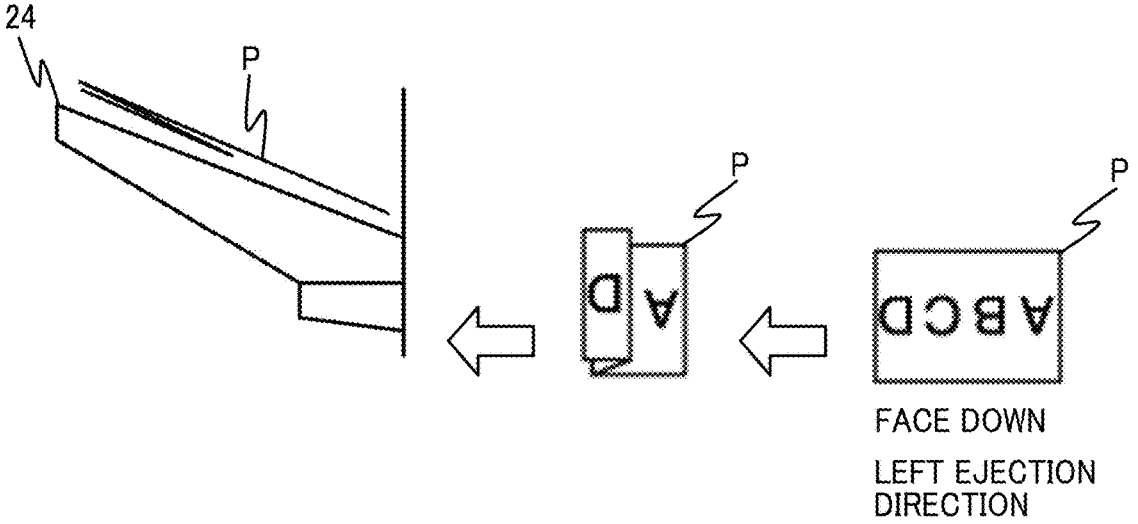
FIG. 22 is a diagram illustrating a sheet folding operation performed by the sheet folding device and imposition of images on a sheet.

FIG. 22 is a diagram illustrating a sheet folding operation performed by the sheet folding device 200 (200*a*) and imposition of images on a sheet.

Figure 23:
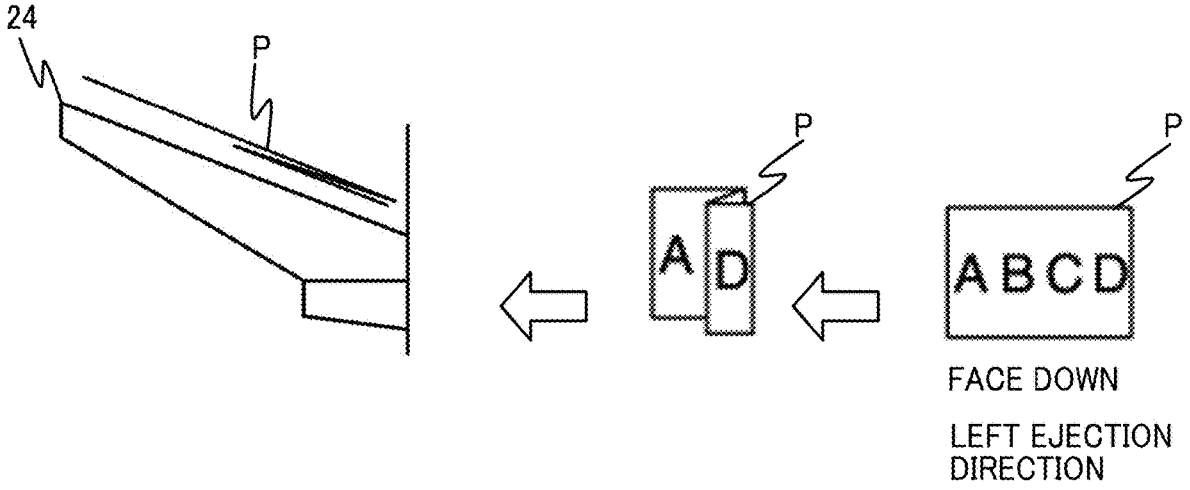
FIG. 23 is a diagram illustrating another sheet folding operation performed by the sheet folding device and another imposition of images on a sheet.

FIG. 23 is a diagram illustrating another sheet folding operation performed by the sheet folding device 200 (200*a*) and another imposition of images on a sheet.

The sheet folding device 200 (200*a*) and the image forming apparatus 100 are capable of performing data transmission with each other by a communication unit. The sheet folding device controller 50 of the sheet folding device 200 (200*a*) receives information for setting the fold to be the leading end or the trailing end, from the image forming apparatus 100.

When the sheet P is conveyed from the image forming apparatus 100, the sheet folding device controller 50 switches the setting on the leading end of the sheet P for the Z-fold operation, between the leading end fold setting and the trailing end fold setting. For example, the leading end fold setting (mode) is selected when the post-processing apparatus 300 described below performs a stapling operation to bundle and staple the sheets P. Further, in a case in which the stapled sheet bundle P is ejected to the sheet stacking tray 24, the trailing end fold setting (mode) is selected.

Further, by switching imposition of the images on the sheet P, the sheet folding device 200 (200*a*) and the image forming apparatus 100 maintain the constant position of the fold to the image. When the sheets P are stacked with the Z-fold portion being the leading end, the images A, B, C, and D are formed on the surface facing down and the images are imposed such that the image D is formed on the leading end of the sheet P in the sheet conveyance direction (left ejection direction in FIG. 22), as illustrated in FIG. 22. By contrast, when the sheets P are stacked with the Z-fold portion being the trailing end, the images A, B, C, and D are formed on the surface facing down and the images are imposed such that the image A is formed on the leading end of the sheet P in the sheet conveyance direction (left ejection direction in FIG. 22), as illustrated in FIG. 23.

As described above, by changing the imposition of images on the sheet P when the image forming apparatus 100 forms the images on the sheet P, according to the sheet stacking direction on how to stack the Z-folded sheets P on the sheet stacking tray 24, the constant position of the fold to the image is maintained.

The above-described imposition setting is made by which the image forming apparatus controller 10 controls the image forming device 20 based on the "folding method" and the "sheet ejection direction" that were set by the image forming apparatus controller 10. In a case in which the sheet folding device controller 50 controls the setting of the folding method of the sheet P and the sheet stacking direction, the set data may be notified to the image forming apparatus controller 10.

As described above, the sheet folding device 200 (200*a*) and the image forming apparatus 100 exchange instructions on whether the sheets P are stacked on the sheet stacking tray 24 in the sheet stacking direction with the folded portions at the leading end or the trailing end when performing the Z-fold operation. That is, the sheet folding device controller 50 switches the control according to the instruction, from the image forming apparatus 100 to the sheet folding device 200 (200*a*), on which the Z-folded sheets P are stacked in the sheet stacking direction with the leading end fold setting or the trailing end fold setting. Alternatively, the sheet folding device controller 50 may notify the setting information of whether the Z-folded sheets P are stacked with the leading end fold setting or the trailing end fold setting, to the image forming apparatus controller 10 of the image forming apparatus 100, and then the image forming apparatus controller 10 may switch the imposition of the image surface based on the setting information notified by the sheet folding device controller 50.

After the imposition of images is changed in the Z-fold operation, when the image forming apparatus controller 10 causes the image forming apparatus 100 to form images on the sheet P on which the sheet folding operation is not performed, the image forming apparatus controller 10 changes the imposition of images on the sheet P without the sheet folding operation. By so doing, the images on the sheet P without the sheet folding operation are prevented to be printed upside down.

Stacking States of Sheets P

Next, a description is given of the sheet conveyance mode of the sheet P to be switched according to a unit of sheet ejection (sheet stacking) when the Z-fold operation is performed on the sheets P.

First, the stacking states of the sheets P to be stacked on the sheet stacking tray 24 are described. A sheet conveyance mode in which the folded portion of the sheet P is brought to the root end of the sheet stacking tray 24 is represented as a "trailing end folded sheet conveyance mode." Further, another sheet conveyance mode in which the folded portion of the sheet P is not brought to the root end of the sheet stacking tray 24 is represented as a "leading end folded sheet conveyance mode." The sheet folding device 200 may switch the sheet conveyance mode in a predetermined unit of processing.

The "unit of processing" represents a unit used for switching the sheet stacking direction of the Z-folded sheets P in the sheet stacking tray 24 between the "leading end fold" or the "trailing end fold." Accordingly, the sheet conveyance mode is switched according to a unit of processing.

First Example of Stacking State

Figure 24:
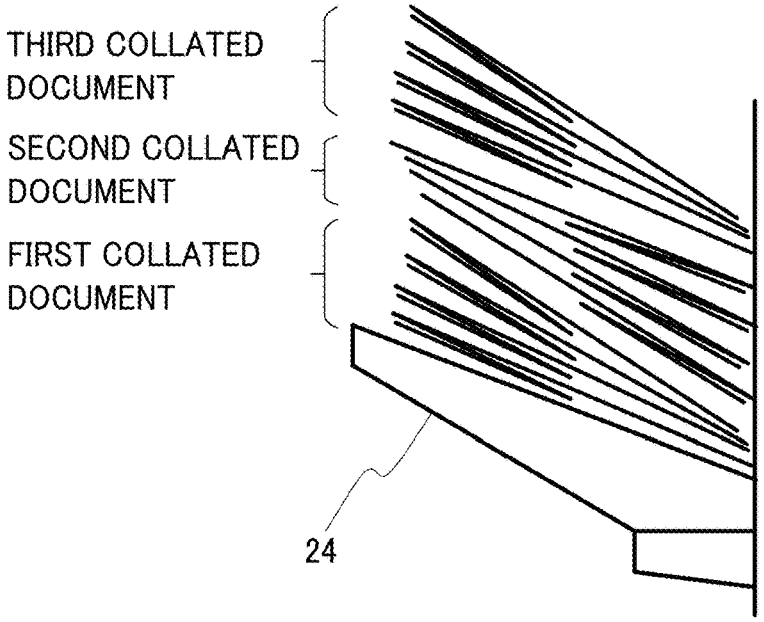
FIG. 24 is a diagram illustrating a stacking state of folded sheets in the sheet folding device.

FIG. 24 is a diagram illustrating a stacking state of folded sheets in the sheet folding device 200 (200*a*).

For example, as illustrated in FIG. 24, the sheet stacking direction of the sheets P is switched by a constant "collated document." A plurality of sheets, in other words, a bundle of sheets, having images on at least one face of each sheet is referred to as a collated document of printed sheets P. When a plurality of collated documents of Z-folded sheets P is ejected to the sheet stacking tray 24, the Z-folded sheets P in one collated document are stacked in the same sheet stacking direction. When the plurality of collated documents of sheets P are stacked in the same sheet stacking direction, the thicker portions of each sheet P are overlaid on one another, causing an unstable stacking of the sheets P on the sheet stacking tray 24. In order to avoid this inconvenience, switching the sheet stacking direction of the sheets P by collated document achieves the stable stacking state of the sheets P on the sheet stacking tray 24. Note that FIG. 24 illustrates an example in which one collated document includes three sheets P.

Note that the sheet folding device 200 and the image forming apparatus 100 are capable of performing data transmission with each other by the communication unit. By receiving information on switching of the collated documents of sheets P, from the image forming apparatus 100, the sheet folding device 200 switches the control to determine whether the sheet P is folded at the leading end or the trailing end. Examples of the information transmitted and received by the communication unit include a method of determining the fold position on the sheets P of each collated document and a method of switching to another fold position different from the fold position on the sheets P of a previous collated document based on information indicating the switching of the collated documents of the sheets P.

Second Example of Stacking State

Figure 25:
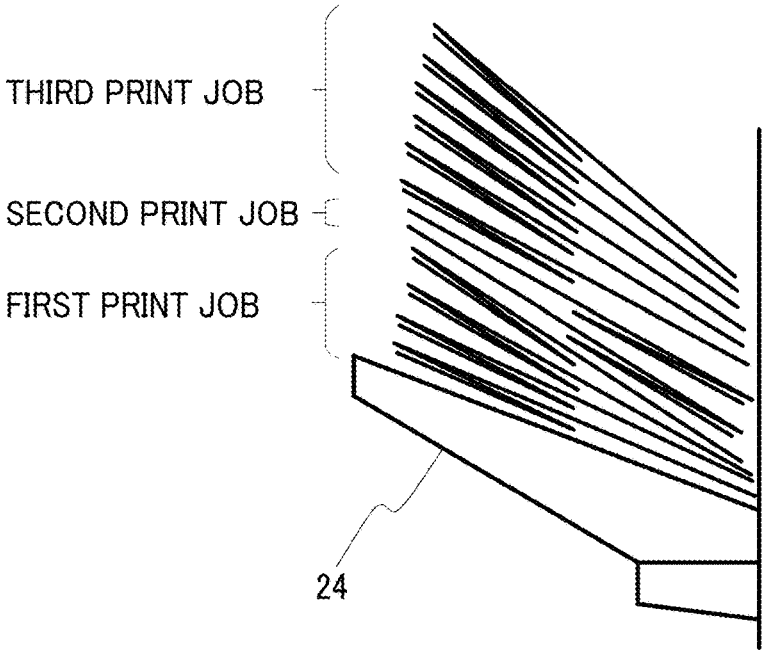
FIG. 25 is a diagram illustrating another stacking state of folded sheets in the sheet folding device.

Further, FIG. 25 is a diagram illustrating another stacking state of folded sheets in the sheet folding device 200 (200*a*).

As illustrated in FIG. 25, the sheet stacking direction of the sheets P may be switched by print jobs. While executing a plurality of print jobs, in a case in which the Z-fold operation is performed on the sheet P on which images are formed in each of the plurality of print jobs, when the whole sheets P of the plurality of print jobs are stacked in the same sheet stacking direction, the thicker portions of the sheets P are overlaid on one another, causing an unstable stacking of the sheets P on the sheet stacking tray 24. In order to avoid this inconvenience, switching the sheet stacking direction of the sheets P by print job achieves the stable stacking state of the sheets P on the sheet stacking tray 24. Note that, in the example illustrated in FIG. 25, the first print job including four (4) sheets P, the second print job including two (2) sheets P, and the third print job including six (6) sheets are stacked on the sheet stacking tray 24.

Note that the sheet folding device 200 and the image forming apparatus 100 are capable of performing data transmission with each other by a communication unit. Due to such a configuration, the sheet folding device 200 receives information on switching of the print jobs of sheets P, from the image forming apparatus 100. By so doing, the sheet folding device 200 switches the control to determine whether the sheet P is folded at the leading end or the trailing end. Further, examples of the information transmitted and received by the communication unit include a method of determining the fold position on the sheets P of each print job and a method of switching to another fold position different from the fold position on the sheets P of a previous print job based on information indicating the switching of the print jobs of the sheets P.

Third Example of Stacking State

Figure 26:
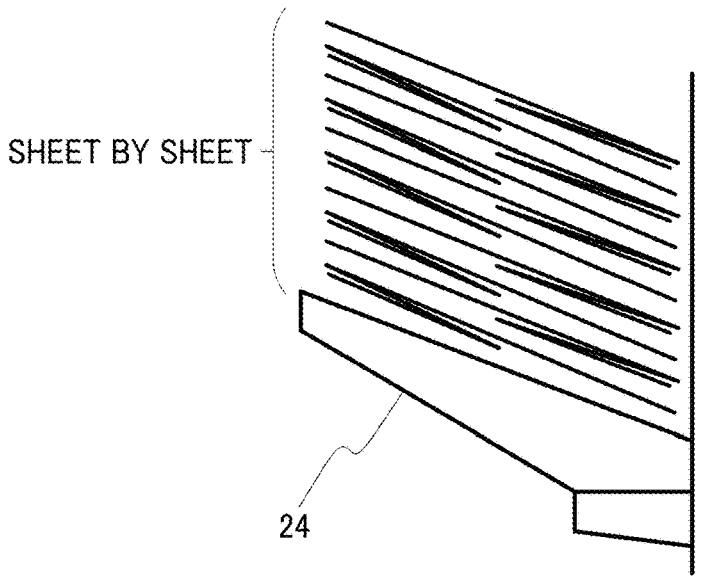
FIG. 26 is a diagram illustrating yet another stacking state of folded sheets in the sheet folding device.

Further, FIG. 26 is a diagram illustrating yet another stacking state of folded sheets in the sheet folding device 200 (200*a*).

As illustrated in FIG. 26, the sheet stacking direction of the sheets P may be switched by sheet P (by a unit of sheet). In this case, the sheet folding device 200 receives information on switching the sheet stacking direction of the Z-folded sheets P sheet by sheet, from the image forming apparatus 100, and the sheet folding device controller 50 determines whether the fold of the sheet P is set to the leading end or the trailing end, according to the information. Then, the sheet folding device controller 50 causes the sheet folding device 200 to perform the Z-fold operation on the sheet P based on the determination result. Note that examples of the information transmitted and received by the communication unit include a method of determining the fold position on the sheets P of each sheet and a method of switching to another fold position different from the fold position on the sheets P of a previous sheet based on information indicating the switching of the sheet.

Fourth Example of Stacking State

Note that, when the setting of the sheet stacking direction is made in the image forming apparatus 100, the sheet folding device controller 50 may change the sheet stacking direction of the sheet P based on the setting made in the image forming apparatus 100, regardless of a unit of collated document, print job, or switching the folded portions.

Figure 27:
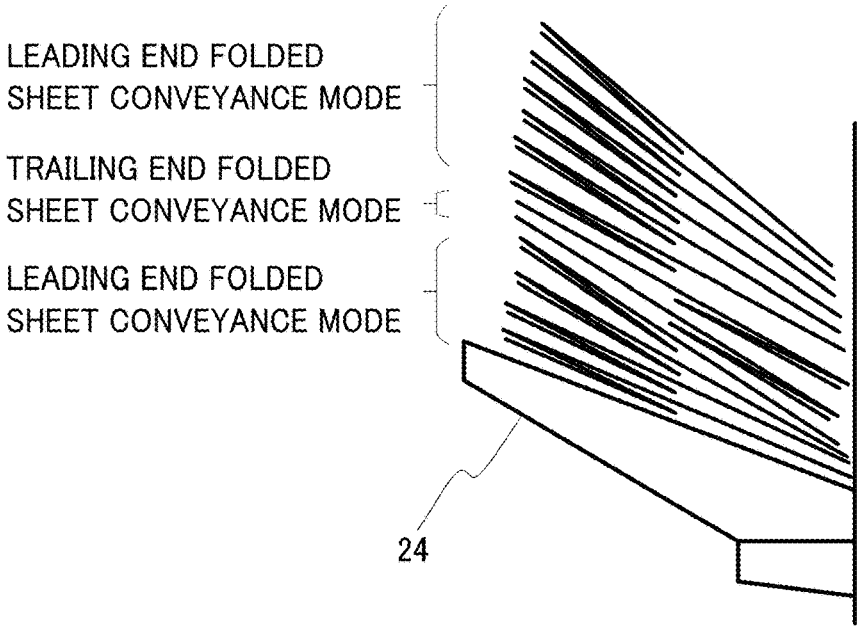
FIG. 27 is a diagram illustrating yet another stacking state of folded sheets in the sheet folding device.

For example, FIG. 27 is a diagram illustrating yet another stacking state of folded sheets in the sheet folding device 200 (200*a*).

As illustrated in FIG. 27, the sheet stacking direction may be changed accordingly based on the setting, so as to stack the Z-folded sheets P on the sheet stacking tray 24. Note that examples of the information transmitted and received by the communication unit include a method of determining the fold position on the sheets P of each sheet and a method of switching to another fold position different from the fold position on the sheets P of a previous sheet based on information indicating the switching of the sheet.

Fifth Example of Stacking State

FIGS. 28A to 28E are diagrams, each illustrating yet another stacking state of folded sheets in the sheet folding device 200 (200*a*).

As illustrated in FIGS. 28A to 28E, the sheet stacking direction of the sheets P may be switched (changed) according to the amount (number) of the sheets P stacked on the sheet stacking tray 24. As illustrated in FIGS. 28A to 28E, a plurality of sensors, each functioning as a sheet stacking amount detector, are disposed proximate to the root end of the sheet stacking tray 24, in the sheet stacking direction of the sheet P. As illustrated in FIGS. 28A to 28E, the plurality of sheet sensors includes a trailing end stack detection sensor SN6, a leading end stack detection sensor SN7, and a sheet face detection sensor SN8. The trailing end stack detection sensor SN6 detects the stacking state of the trailing end of the sheets P stacked on the sheet stacking tray 24. The leading end stack detection sensor SN7 detects the stacking state of the leading end of the sheets P stacked on the sheet stacking tray 24.

The sheet folding device controller 50 determines and switches the sheet stacking direction of the sheets P on the sheet stacking tray 24 on whether the fold of the sheets P is formed at the leading end or the trailing end, based on the detection results of the state of the sheets P detected by the trailing end stack detection sensor SN6 and the leading end stack detection sensor SN7. In other words, the sheet folding device controller 50 switches between the leading end folded sheet conveyance mode and the trailing end folded sheet conveyance mode, based on a detection result of the trailing end stack detection sensor SN6 and the leading end stack detection sensor SN7. The trailing end stack detection sensor SN6 is disposed proximate to the root end of the sheet stacking tray 24 to detect the sheet P at the lowermost position on the inclined face of the sheet stacking tray 24. The leading end stack detection sensor SN7 is disposed in a direction parallel to the inclined face of the sheet stacking tray 24 to detect the presence or absence of the sheet P at the detection position.

The sheet face detection sensor SN8 is used to detect the position of the surface of the sheet P stacked on the sheet stacking tray 24. By using the sheet face detection sensor SN8, the position of the surface of the sheet P is maintained at a constant height.

Figure 28C:
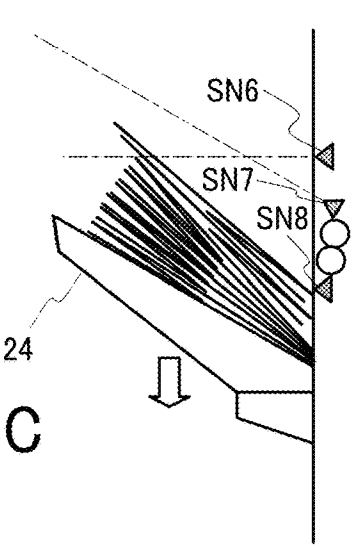
FIGS. 28A to 28E are diagrams, each illustrating yet another stacking state of folded sheets in the sheet folding device.
Figure 28B:
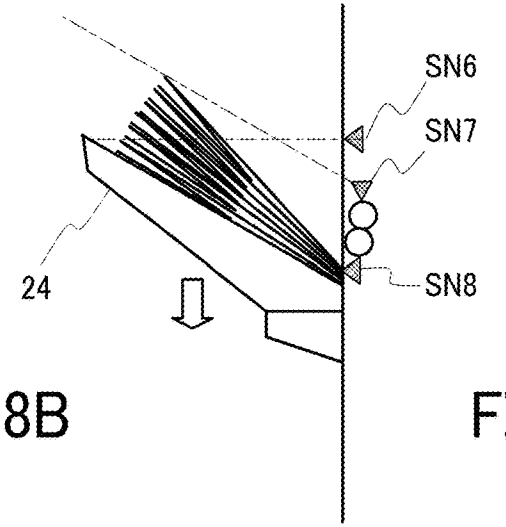
Figure 28A:
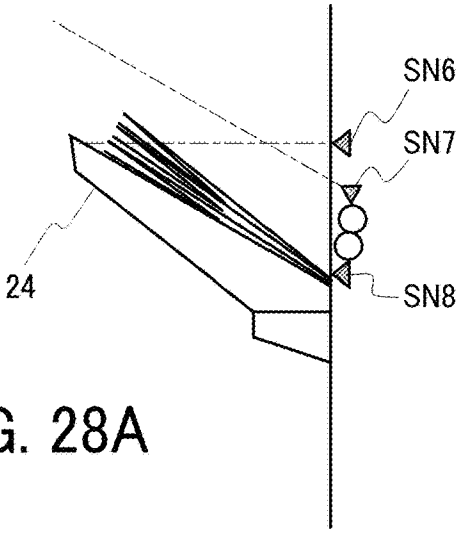

Firstly, as illustrated in FIG. 28A, the Z-folded sheet P is ejected to the sheet stacking tray 24, with the fold at the leading end of the sheet P. In this state of FIG. 28A, the trailing end stack detection sensor SN6 detects the sheet P and the leading end stack detection sensor SN7 does not detect the sheet P. In response to the detection results, the subsequent Z-folded sheets P are continuously ejected with the fold at the leading end of the subsequent Z-folded sheets P.

Then, as illustrated in FIG. 28B, as the Z-folded sheets P are continuously stacked on the sheet stacking tray 24 from the state of FIG. 28A, the leading end stack detection sensor SN7 comes to detect the sheets P. In this state of FIG. 28B, the sheet folding device controller 50 determines that the stack amount (number) of sheets P exceeds the predetermined stack amount of sheets P on the sheet stacking tray 24 with the fold at the leading end of the Z-folded sheets P, and switches the sheet stacking direction of the Z-folded sheets P to stack the Z-folded sheets P with the fold at the trailing end. Then, the position of the sheet stacking tray 24 is lowered so that the leading end stack detection sensor SN7 does not detect the sheets P.

After the sheet stacking direction of the Z-folded sheets P is switched to stack the Z-folded sheets P with the fold at the trailing end, the Z-folded sheets P are further stacked on the sheet stacking tray 24 to the state of FIG. 28C. At this time, the stack amount of the Z-folded sheets P is detected by the trailing end stack detection sensor SN6. In FIG. 28C, the Z-folded sheets P are detected by the trailing end stack detection sensor SN6. Then, the sheet stacking tray 24 is lowered to the position illustrated in FIG. 28D and the Z-folded sheets P are continuously stacked on the sheet stacking tray 24 with the fold at the trailing end.

Figure 28E:
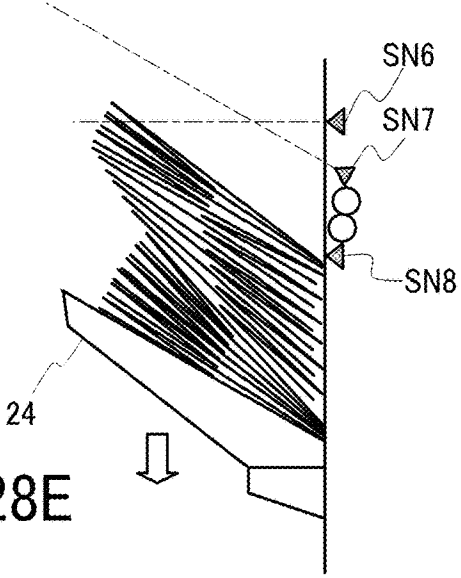
Figure 28D:
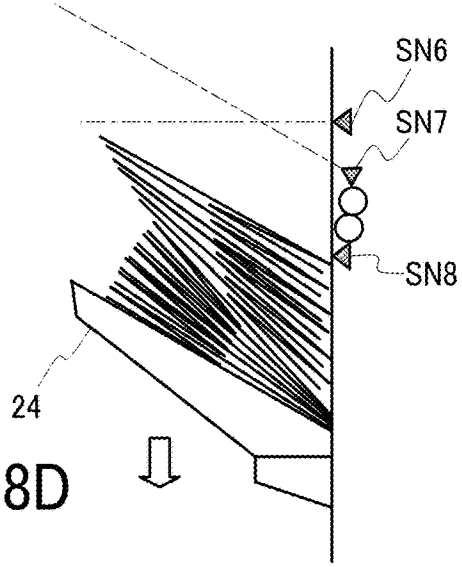

Then, as the Z-folded sheets P with the fold at the trailing end are further stacked, the trailing end stack detection sensor SN6 detects the Z-folded sheets P. In response to the detection of the trailing end stack detection sensor SN6, the sheet stacking direction of the Z-folded sheets P is switched to stack the Z-folded sheets P with the fold at the leading end. This state is illustrated in FIG. 28E. Then, the Z-folded sheets P are continuously stacked, and the operations illustrated in FIGS. 28A to 28E are repeated, until the sheet stacking tray 24 is lowered to the lowermost position.

As described above, the sheet processing device (i.e., the sheet folding device 200 and the sheet folding device 200*a*) switches the position of the fold formed on the Z-folded sheet P to be stacked on the sheet stacking tray 24, between the leading end of the Z-folded sheet P and the trailing end of the Z-folded sheet P, so as to level the thickness difference in the Z-folded sheet P in the sheet ejection direction as flat as possible.

Note that the sheet stacking direction of the Z-folded sheet P may be switched according to the type of sheet (sheet type) and the thickness of sheet (sheet thickness). In other words, the sheet folding device controller 50 switches between the leading end folded sheet conveyance mode and the trailing end folded sheet conveyance mode, according to a type of the sheet or a thickness of the sheet. In this case, the sheet stacking direction of the Z-folded sheet P may be switched based on the "sheet type information" or the "sheet thickness information", each being included in the information notified from the image forming apparatus controller 10 to the sheet folding device controller 50. Based on each information, the sheet folding device controller 50 may calculate the height of the Z-folded sheets P stacked on the sheet stacking tray 24, per a unit of the number of Z-folded sheets P. Then, based on the calculated height, the sheet folding device controller 50 may switch the sheet stacking direction of the Z-folded sheets P on whether the fold is formed at the leading end or the trailing end.

The information notified from the image forming apparatus controller 10 to the sheet folding device controller 50 may include a method of determining the position of the fold on the sheet P for each job and a method of switching the position of the fold on the sheet P to a different position from the previous job according to the information indicating the switch of the job.

Third Embodiment of Sheet Folding Device 200

Next, a description is given of the sheet folding device 200 according to a third embodiment of the present disclosure.

Figure 29:
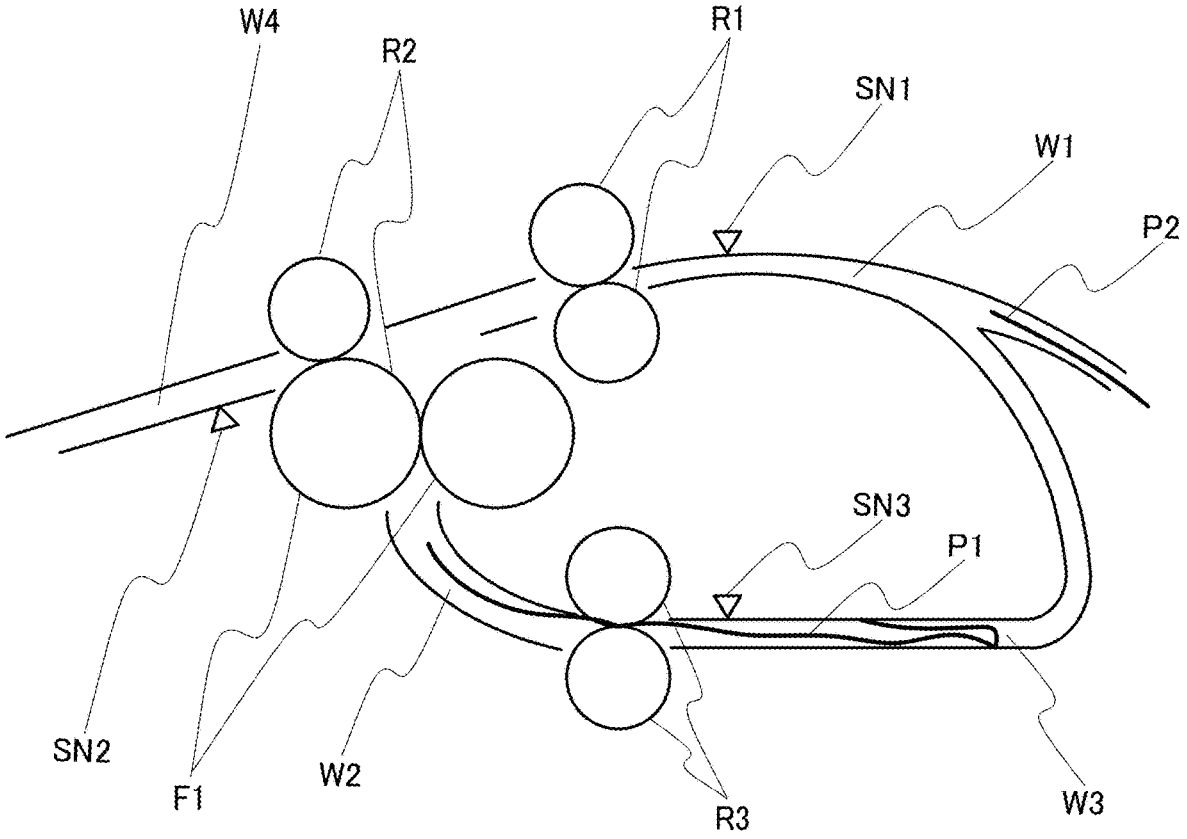
FIG. 29 is an enlarged view of the inner configuration of the sheet folding device according to a third embodiment.

FIG. 29 is an enlarged view of the inner configuration of the sheet folding device 200 according to a third embodiment.

Figure 30:
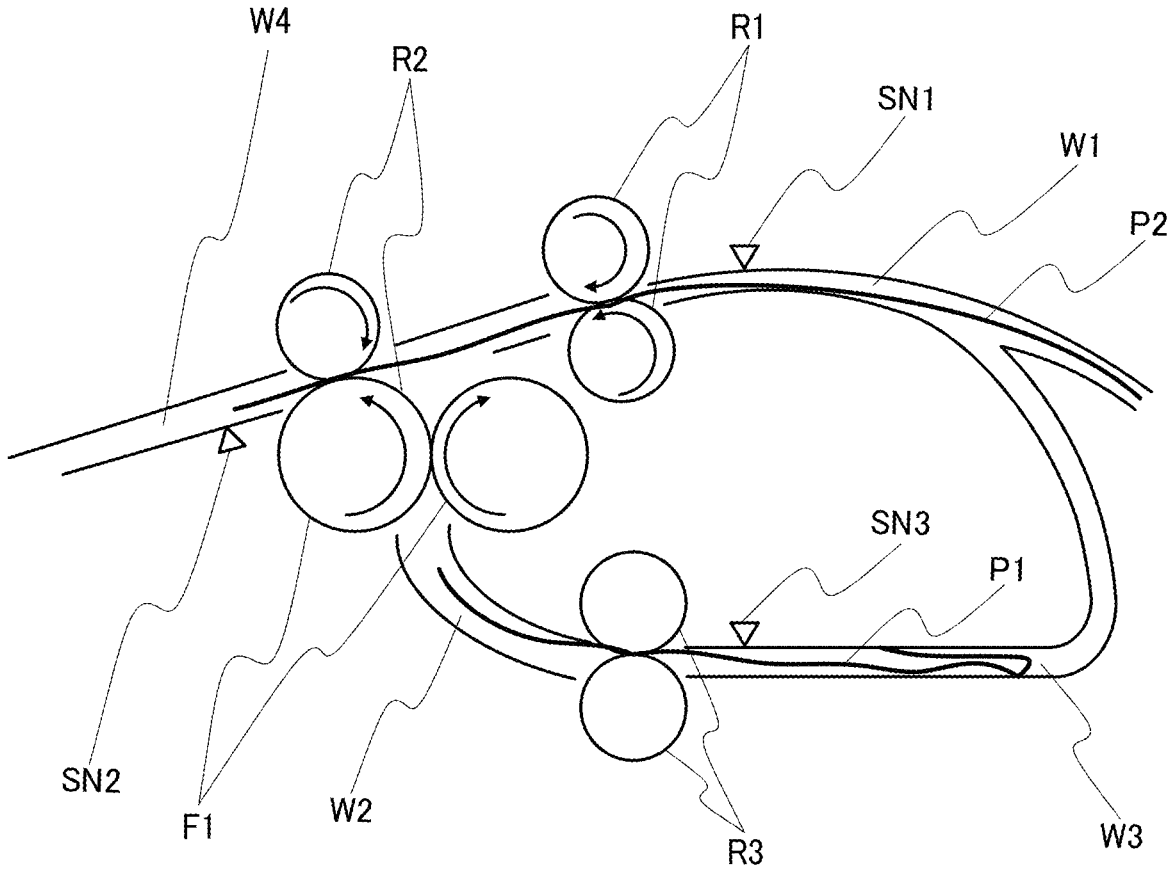
FIG. 30 is an enlarged view of the inner configuration of the sheet folding device according to the third embodiment, following FIG. 29.

FIG. 30 is an enlarged view of the inner configuration of the sheet folding device 200 according to the third embodiment, following FIG. 29.

Figure 31:
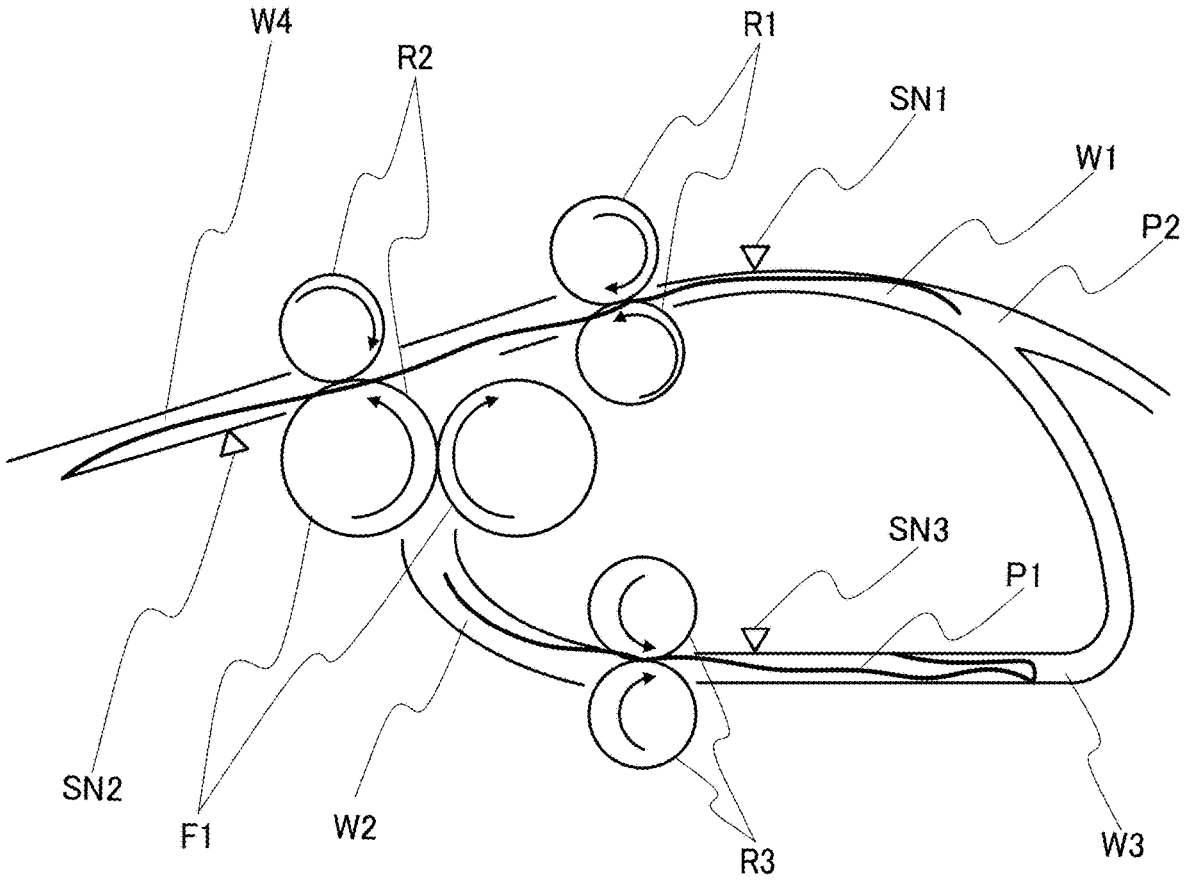
FIG. 31 is an enlarged view of the inner configuration of the sheet folding device according to the third embodiment, following FIG. 30.

FIG. 31 is an enlarged view of the inner configuration of the sheet folding device 200 according to the third embodiment, following FIG. 30.

In the present embodiment, while the sheet folding device 200 is performing the sheet folding operation on a first sheet P (i.e., preceding sheet P1) and before the folded first sheet P (i.e., the folded preceding sheet P1) is ejected, the sheet folding device 200 concurrently performs an interruption operation in which a second sheet P (i.e., subsequent sheet P2) is conveyed to the sheet folding device 200.

In a case in which an image forming operation is instructed via the control panel 40 of the image forming apparatus 100 from an external device connected to the image forming apparatus 100, so as to perform the image forming operation by interrupting the on-going sheet folding operation being performed on the first sheet P (i.e., preceding sheet P1). Then, the second sheet P (i.e., subsequent sheet P2) is received by the sheet folding device 200 that is concurrently performing the sheet folding operation.

Note that, in a case in which the image forming apparatus 100 receives a plurality of image forming instructions, the interruption operation may be performed due to the operation control by the image forming apparatus 100.

When the sheet folding device 200 does not perform the sheet folding operation on the subsequent sheet P2, the sheet folding device 200 receives the subsequent sheet P2 in a state in which the preceding sheet P1 is stopped in the housing of the sheet folding device 200, in other words, in the middle of conveyance in the sheet conveyance passage in the sheet folding device 200. For example, as illustrated in FIG. 29, the subsequent sheet P2 is conveyed to the sheet folding device 200 at a timing at which the preceding sheet P1 is temporarily stopped in the second sheet conveyance passage W2 or the third sheet conveyance passage W3 after the first folding operation is performed on the preceding sheet P1. At this time, the preceding sheet P1 is held in the second conveyance passage W2 or the third conveyance passage W3.

At this timing, when the subsequent sheet P2 is conveyed to the image forming apparatus 100, the sheet folding device controller 50 causes the first sheet conveyor R1 and the second sheet conveyor R2 to rotate while temporarily stopping the operation on the preceding sheet P1, as illustrated in FIG. 30. Preferably, when the leading end P01 of the subsequent sheet P2 is detected by the first sheet detection sensor SN1, the sheet folding device controller 50 may cause the first sheet conveyor R1 and the second sheet conveyor R2 to rotate. As described above, since the sheet folding device controller 50 controls the operation, the subsequent sheet P2 passes through the first sheet conveyance passage W1 and the fourth sheet conveyance passage W4 to be conveyed and ejected prior to ejection of the preceding sheet P1.

Note that, when the sheet folding device 200 performs the sheet folding operation on the subsequent sheet P2, the sheet folding device 200 does not stop the preceding sheet P1 to receive the subsequent sheet P2 and continuously convey the preceding sheet P1. In other words, the sheet folding device 200 receives the subsequent sheet P2 after the sheet folding operation on the preceding sheet P1 is finished. In this case, the stop timing and the conveyance restart timing of the preceding sheet P1 and the reception timing of the subsequent sheet P2 are described as follows.

As illustrated in FIG. 31, after the first folding operation on the preceding sheet P1 is finished, the sheet folding device 200 receives the subsequent sheet P2 while conveyance of the preceding sheet P1 is temporarily stopped in the housing of the sheet folding device 200. At this time, the preceding sheet P1 is stopped in the state in which the trailing end of the preceding sheet P1 have passed through the nip region of the first sheet folder F1 and the leading end of the preceding sheet P1 is in the third sheet conveyance passage W3. In this state, the sheet folding device 200 receives the subsequent sheet P2.

Then, after the trailing end of the subsequent sheet P2 has passed the connection point (i.e., the merging point) of the first sheet conveyance passage W1 and the third sheet conveyance passage W3, the sheet folding device 200 restarts conveyance of the preceding sheet P1.

By controlling as described above, the sheet folding device 200 enhances the processing efficiency of the sheet folding operation when the sheet folding device 200 performs the sheet folding operation consecutively. Further, when a sheet P on which the Z-fold operation is performed and another sheet P on which the Z-fold operation is not performed are conveyed to the sheet folding device 200 in a mixed manner, the sheet folding device 200 ejects the sheet P on which the Z-fold operation is not performed, prior to the sheet P on which the Z-fold operation is performed. By so doing, the processing efficiency of the sheet folding device 200 is enhanced.

Embodiment of Image Forming System

A description is given of a configuration of an image forming system according to an embodiment of the present disclosure.

Figure 32:
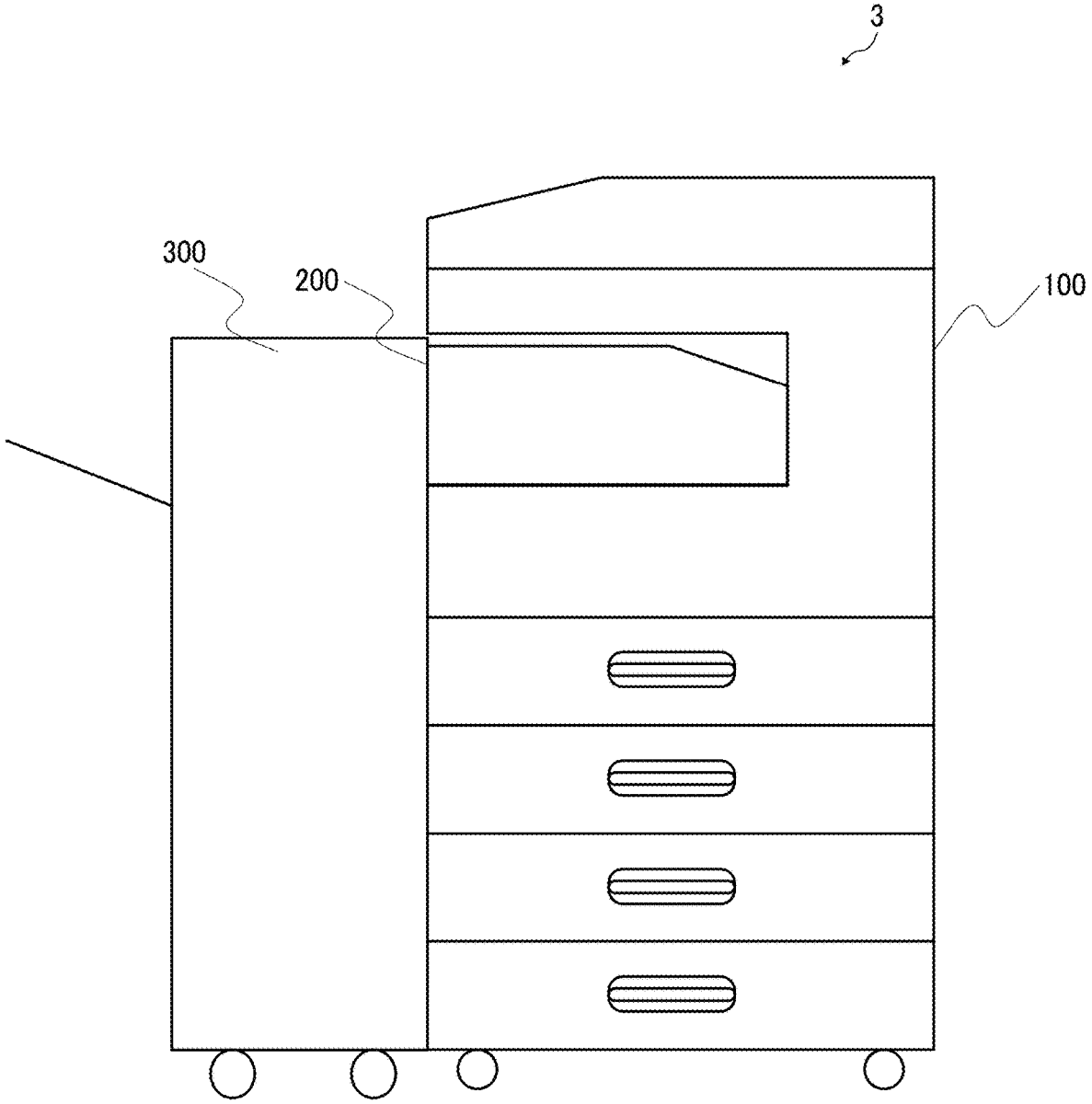
FIG. 32 is a diagram illustrating a configuration of an image forming system according to the present embodiment of the present disclosure.

FIG. 32 is a diagram illustrating a configuration of an image forming system according to the present embodiment of the present disclosure.

Figure 33:
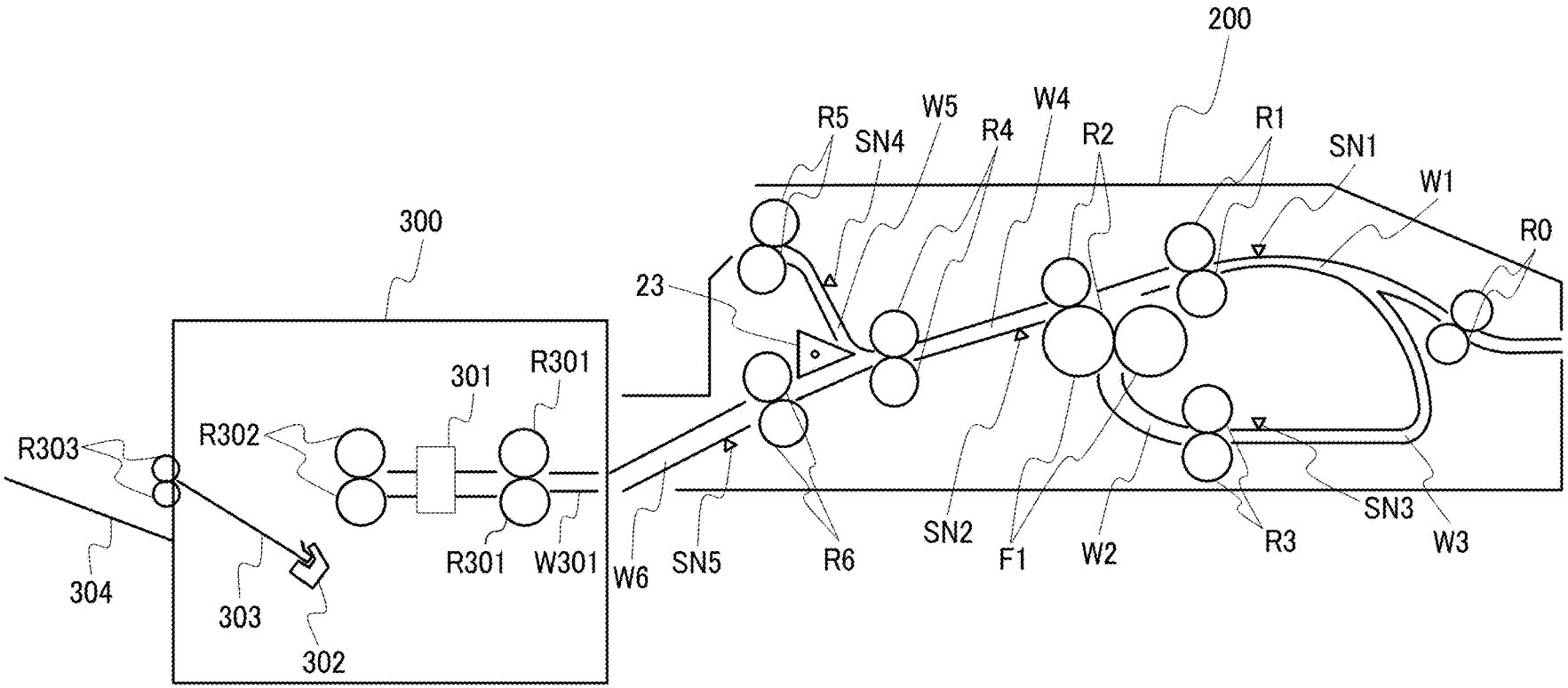
FIG. 33 is a diagram illustrating an inner configuration of the image forming system according to an embodiment of the present disclosure.

FIG. 33 is a diagram illustrating an inner configuration of the image forming system according to an embodiment of the present disclosure.

As illustrated in FIG. 32, an image forming system 3 according to the present embodiment includes a post-processing apparatus 300 disposed downstream from the sheet folding device 200. The post-processing apparatus 300 includes a post-processing sheet conveyance passage W301. As illustrated in FIG. 33, the post-processing sheet conveyance passage W301 in the post-processing apparatus 300 is connected to the sixth sheet conveyance passage W6 of the sheet folding device 200. Along the sixth sheet conveyance passage W6 and the post-processing sheet conveyance passage W301, the sheet P is transferred from the sheet folding device 200 to the post-processing apparatus 300.

Before performing a "hole punching operation" that is a punching operation to make a hole or holes in the sheet P in a punching unit 301 that functions as a post-processing unit, the post-processing apparatus 300 causes the sheet P to contact the post-processing sheet conveyance rollers R301 to correct the inclination of the sheet P while the post-processing sheet conveyance rollers R301 are stopped or reversed. In a case in which the hole punching operation is performed on the sheet P having a fold (or folds), when the fold of the sheet P is formed at the leading end in the sheet conveyance direction, the fold of the sheet P contacts the post-processing sheet conveyance rollers R301. In this case, a "fold misalignment" may occur in a state in which the fold of the sheet P is caught (nipped) by the post-processing sheet conveyance rollers R301.

In order to avoid such a fold misalignment, when performing the hole punching operation, the sheet folding device controller 50 causes the sheet P with the fold at the leading end to be reversed to change the sheet stacking direction of the sheet P, and then causes the sheet folding device 200 to eject the sheet P with the fold at the trailing end. By so doing, the sheet folding device 200 corrects the inclination of the sheet P without contacting the fold of the sheet P against the post-processing sheet conveyance rollers R301. Note that the sheet P is reversed in the manner described in the first embodiment.

The image forming apparatus controller 10 notifies the sheet folding device controller 50 about the information on whether the post-processing apparatus 300 performs the hole punching operation on the sheet P. Due to such a configuration, in a case in which the sheet folding operation in addition to the hole punching operation is set to be performed on the sheet P, the sheet folding device controller 50 causes the sheet folding device 200 to prepare the sheet P having the fold at the trailing end and eject the sheet P to the post-processing apparatus 300.

In a case in which the stapling operation is set to be performed on a Z-folded sheet P as a post-processing operation, the sheet folding device 200 ejects the Z-folded sheet P without changing the sheet ejection direction of the sheet P, in other words, the sheet folding device 200 ejects the Z-folded sheet P with the fold at the leading end.

In this case, the post-processing apparatus 300 ejects the sheet P to the staple tray 303 by the second post-processing rollers R302 to stack the sheet P on the staple tray 303. The stapler 302 performs the stapling operation on the trailing end of the bundle of sheets P stacked on the staple tray 303. After the stapling operation is performed on the bundle of sheets P, the post-processing sheet ejection rollers R303 eject the bundle of sheets P to the post-processing sheet ejection tray 304. When the Z-folded sheet P is reversed, the fold is located at the trailing end of the sheet P. As a result, the stapling operation is performed on the folds (folded portions) of the sheets P. In order to avoid this inconvenience, in the image forming system 3 including the post-processing apparatus 300 having the function of stapling operation, when the stapling operation is set, it is controlled that the fold is formed at the leading end of the Z-folded sheet P and that the imposition of the images is not changed.

Note that whether or not the stapling operation is performed on the bundle of sheets P is notified from the image forming apparatus controller 10 to the sheet folding device controller 50. Due to such a configuration, as long as the sheet folding device controller 50 controls the sheet folding operation based on the notification from the image forming apparatus controller 10, the bundle of sheets P are ejected with the fold on the leading end of each sheet P.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet processing device comprising:

a first conveyance passage configured to pass a sheet downstream in a sheet conveyance direction;

a first conveyor configured to convey the sheet in the first conveyance passage;

a second conveyor disposed downstream from the first conveyor in the sheet conveyance direction;

a folder disposed between the first conveyor and the second conveyor, the folder being configured to form a fold on the sheet;

a second conveyance passage configured to circulate, to the first conveyance passage, the sheet with the fold being formed after the sheet passes through the folder; and circuitry configured to:

(1) cause the first conveyor to convey the sheet in the sheet conveyance direction and the second conveyor to convey the sheet in a reverse direction opposite to the sheet conveyance direction while the first conveyor and the second conveyor nip the sheet, to warp the sheet between the first conveyor and the second conveyor;

(2) guide the sheet warped between the first conveyor and the second conveyor, to the folder, to form a first fold on the sheet by the folder, and cause the sheet to be circulated to the first conveyance passage via the second conveyance passage;

(3) cause the first conveyor to convey the sheet in the sheet conveyance direction and the second conveyor to convey the sheet in the reverse direction opposite to the sheet conveyance direction while the first conveyor and the second conveyor nip the sheet again, to warp the sheet between the first conveyor and the second conveyor;

(4) guide the sheet warped between the first conveyor and the second conveyor, to the folder, to form a second fold on the sheet by the folder; and (5) cause the second conveyor to convey the sheet with the first fold and the second fold, in the sheet conveyance direction.

2. The sheet processing device according to claim 1, further comprising:

a third conveyor configured to receive the sheet after the sheet passes through the folder;

another folder disposed between the folder and the third conveyor, said another folder including two rollers, said another folder sharing one of the two rollers with of the folder; and a third conveyance passage configured to circulate the sheet by the third conveyor, to the first conveyance passage, wherein the circuitry is configured to:

(1) cause the first conveyor to convey the sheet in the sheet conveyance direction and the second conveyor to convey the sheet in the reverse direction while the first conveyor and the second conveyor nip the sheet, to warp the sheet between the first conveyor and the second conveyor;

(2) guide the sheet warped between the first conveyor and the second conveyor, to the folder, to form the first fold on the sheet by the folder;

(3) cause the first conveyor to convey the sheet in the sheet conveyance direction and the third conveyor to convey the sheet in the reverse direction opposite to the sheet conveyance direction while the first conveyor and the third conveyor nip the sheet with the first fold, to warp the sheet between the first conveyor and the third conveyor; and (4) guide the sheet warped between the first conveyor and the third conveyor, to said another folder, to form the second fold on the sheet by said another folder, and cause said another folder to convey the sheet with the first fold and the second fold, in the sheet conveyance direction.

3. The sheet processing device according to claim 1, wherein the circuitry is configured to:

form the first fold on a trailing end of the sheet, at a position corresponding to one-fourth of a length of the sheet in the sheet conveyance direction; and form the second fold on the sheet, at a position corresponding to half of the length of the sheet in the sheet conveyance direction.

4. The sheet processing device according to claim 1, wherein, when another sheet is conveyed to the first conveyance passage while the fold is being formed on the sheet, the circuitry is configured to cause the first conveyor to convey said another sheet through the first conveyance passage while the sheet is held in a conveyance passage different from the first conveyance passage.

5. The sheet processing device according to claim 1, wherein the circuitry is configured to select between a leading end folded sheet conveyance mode in which the sheet is conveyed in the sheet conveyance direction with the second fold as a leading end of the sheet and a trailing end folded sheet conveyance mode in which the sheet is conveyed in the sheet conveyance direction with the second fold as a trailing end of the sheet.

6. The sheet processing device according to claim 5, wherein the circuitry is configured to change between the leading end folded sheet conveyance mode and the trailing end folded sheet conveyance mode according to a unit of sheet ejection of the sheet, and wherein the unit of sheet ejection is a collated document.

7. The sheet processing device according to claim 5, wherein the circuitry is configured to change between the leading end folded sheet conveyance mode and the trailing end folded sheet conveyance mode according to a unit of sheet ejection of the sheet, and wherein the unit of sheet ejection is a print job.

8. The sheet processing device according to claim 5, wherein the circuitry is configured to change between the leading end folded sheet conveyance mode and the trailing end folded sheet conveyance mode according to a unit of sheet ejection of the sheet, and wherein the unit of sheet ejection is a sheet.

9. The sheet processing device according to claim 5, further comprising:

a sheet tray configured to stack the sheet with the first fold and the second fold; and a sheet sensor configured to detect a stack amount of the sheet on the sheet tray, wherein the circuitry is configured to switch between the leading end folded sheet conveyance mode and the trailing end folded sheet conveyance mode, based on a detection result of the sheet sensor.

10. The sheet processing device according to claim 5, wherein the circuitry is configured to switch between the leading end folded sheet conveyance mode and the trailing end folded sheet conveyance mode, according to a type of the sheet or a thickness of the sheet.

11. An image forming system comprising:

an image forming apparatus configured to form an image on a sheet; and the sheet processing device according to claim 1, the sheet processing device being configured to perform a sheet folding operation to form a fold on the sheet.

12. The image forming system according to claim 11, wherein the image forming apparatus includes circuitry configured to change imposition of the image on the sheet, according to the sheet folding operation to be performed on the sheet by the sheet processing device.

13. The image forming system according to claim 12, wherein the circuitry of the image forming apparatus is configured to change the imposition of the image again, when the image forming apparatus forms an image on another sheet not subjected to the sheet folding operation after the circuitry of the image forming apparatus changes the imposition of the image on the sheet, according to the sheet folding operation to be performed on the sheet by the sheet processing device.

14. An image forming system comprising:

an image forming apparatus configured to form an image on a sheet;

the sheet processing device according to claim 1, the sheet processing device being configured to perform a sheet folding operation to form a fold on the sheet; and a post-processing apparatus configured to perform a post-processing operation on the sheet, wherein the circuitry is configured to convey the sheet in the sheet conveyance direction from the sheet folding device to the post-processing apparatus with the second fold as a trailing end of the sheet when the post-processing apparatus performs a punching operation as the post-processing operation, and wherein the circuitry is configured to convey the sheet in the sheet conveyance direction from the sheet folding device to the post-processing apparatus with the second fold as a leading end of the sheet when the post-processing apparatus performs a stapling operation to bind and staple a bundle of sheets including the sheet as the post-processing operation.

15. The image forming system according to claim 14, wherein the image forming apparatus includes circuitry configured to change imposition of the image on the sheet, according to the sheet folding operation to be performed on the sheet by the sheet processing device, and wherein the circuitry of the image forming apparatus is configured to retain the imposition of the image when the post-processing apparatus performs the stapling operation as the post-processing operation on the sheet.

* * * * *